US009121633B2

(12) United States Patent
Jung et al.

(10) Patent No.: US 9,121,633 B2
(45) Date of Patent: Sep. 1, 2015

(54) REFRIGERATOR

(71) Applicant: LG Electronics Inc., Seoul (KR)

(72) Inventors: Moongyo Jung, Seoul (KR); Sanggyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/947,662

(22) Filed: Jul. 22, 2013

(65) Prior Publication Data

US 2014/0021838 A1 Jan. 23, 2014

(30) Foreign Application Priority Data

Jul. 23, 2012 (KR) ..... 10-2012-0080178
Jul. 26, 2012 (KR) ..... 10-2012-0081934

(51) Int. Cl.
*F25D 11/00* (2006.01)
*F25D 17/04* (2006.01)
*F25D 23/06* (2006.01)

(52) U.S. Cl.
CPC ..... *F25D 11/00* (2013.01); *F25D 17/042* (2013.01); *F25D 23/062* (2013.01); *F25D 2317/043* (2013.01)

(58) Field of Classification Search
CPC . F25D 25/02; F25D 17/042; F25D 2317/043; F25D 23/00; A47B 2210/17; A47B 2210/175; A47B 2210/19
USPC ..... 62/404, 447, 62, 449; 312/332.1, 296, 312/242, 402, 404, 236
See application file for complete search history.

(56) References Cited

U.S. PATENT DOCUMENTS

| | | | | | |
|---|---|---|---|---|---|
| 1,843,264 | A | * | 2/1932 | Bales | 312/242 |
| 2,592,233 | A | * | 4/1952 | Atchison | 62/284 |
| 3,004,815 | A | * | 10/1961 | O'Kain et al. | 312/242 |
| 3,554,623 | A | * | 1/1971 | Suckle et al. | 312/7.2 |
| 4,685,581 | A | * | 8/1987 | Kaneda et al. | 220/3.2 |
| 5,897,181 | A | * | 4/1999 | Avendano et al. | 312/401 |
| 5,971,461 | A | * | 10/1999 | Vaishnav et al. | 296/37.12 |
| 6,007,375 | A | * | 12/1999 | Mackowiak et al. | 439/567 |
| 6,170,276 | B1 | * | 1/2001 | Mandel et al. | 62/187 |

(Continued)

FOREIGN PATENT DOCUMENTS

| | | | |
|---|---|---|---|
| CN | 101720417 | A | 6/2010 |
| CN | 101802530 | A | 8/2010 |

OTHER PUBLICATIONS

Chinese abstract and drawing for 103335470 Oct. 2013.*

(Continued)

*Primary Examiner* — Janet M Wilkens
(74) *Attorney, Agent, or Firm* — Dentons US LLP

(57) ABSTRACT

Disclosed is a refrigerator, comprising: a refrigerator body having a cooling chamber; a case comprising a case body having therein an accommodation space of which one side is open, and a transformation preventing member formed of a material having a higher strength than that of the case body, the transformation preventing member provided at an open region of the case body and configured to prevent transformation of the case; a drawer accommodated in the case in a withdrawable manner; and a depressurizing device configured to depressurize inside of the drawer and the case to a pressure lower than an atmospheric pressure, when the drawer is accommodated in the case. Under such configuration, transformation of the case can be prevented, and the case can be easily fabricated.

24 Claims, 26 Drawing Sheets

(56) References Cited

U.S. PATENT DOCUMENTS

| | | | | |
|---|---|---|---|---|
| 6,234,593 | B1 * | 5/2001 | Chen et al. | 312/223.2 |
| 6,480,243 | B2 * | 11/2002 | Yamamoto | 348/836 |
| 8,127,561 | B1 * | 3/2012 | Allard et al. | 62/62 |
| 8,277,005 | B2 * | 10/2012 | Jung et al. | 312/405 |
| 2001/0043290 | A1 | 11/2001 | Yamamoto | |
| 2006/0006771 | A1 * | 1/2006 | Chen | 312/223.2 |
| 2008/0302441 | A1 * | 12/2008 | Kelly et al. | 141/65 |
| 2011/0050066 | A1 * | 3/2011 | Lee et al. | 312/404 |
| 2011/0062834 | A1 * | 3/2011 | Ball et al. | 312/215 |
| 2011/0286181 | A1 * | 11/2011 | Murakata | 361/679.55 |
| 2011/0289957 | A1 * | 12/2011 | Kim et al. | 62/404 |
| 2012/0200211 | A1 * | 8/2012 | Yanni | 312/242 |
| 2013/0340465 | A1 * | 12/2013 | Park et al. | 62/376 |
| 2014/0021846 | A1 * | 1/2014 | Jung et al. | 312/404 |
| 2014/0028171 | A1 * | 1/2014 | Jung et al. | 312/404 |
| 2014/0028172 | A1 * | 1/2014 | Min et al. | 312/404 |
| 2014/0077679 | A1 * | 3/2014 | Lee et al. | 312/404 |

OTHER PUBLICATIONS

Chinese abstract and drawing for 103277964 Sep. 2013.*

* cited by examiner

-PRIOR ART-

-PRIOR ART-

REFRIGERATOR

CROSS-REFERENCE TO RELATED APPLICATION

Pursuant to 35 U.S.C. §119(a), this application claims the benefit of earlier filing date and right of priority to Korean Application Nos. 10-2012-0080178, field on Jul. 23, 2012 and 10-2012-0081934, filed on Jul. 26, 2012, the contents of which is incorporated by reference herein in its entirety.

BACKGROUND OF THE DISCLOSURE

1. Field of the Disclosure

The present disclosure relates to a refrigerator, and particularly, to a refrigerator capable of being easily fabricated with low costs.

2. Background of the Disclosure

As is well known, a refrigerator is an apparatus for storing food items for a long time in a frozen or cool state.

The refrigerator may comprise a refrigerator body having a cooling chamber, a door configured to open and close the cooling chamber, and a refrigerating cycle device configured to provide cool air to the cooling chamber.

FIG. 1 is a perspective view showing an example of a refrigerator in accordance with the conventional art.

As shown in FIG. 1, the refrigerator comprises a refrigerator body 10 having a cooling chamber 20 therein, and a cooling chamber door 30 configured to open and close the cooling chamber 20.

The cooling chamber 20 is provided with a freezing chamber 21 and a refrigerating chamber 22.

The cooling chamber door 30 comprises a freezing chamber door 31 configured to open and close the freezing chamber 21, and a refrigerating chamber door 32 configured to open and close the refrigerating chamber 22.

A plurality of shelves 41, which is configured to partition an inner space of the refrigerating chamber 22 up and down, are provided in the refrigerating chamber 22.

A drawer 70 is provided in the refrigerating chamber 22.

Part of the drawer 70 forms a vegetable storage chamber 50 configured to store vegetables and/or fruits therein.

However, the conventional refrigerator may have the following problems.

The inside of the refrigerating chamber 22 has a relatively low temperature and a dry state, vegetables or fruits accommodated in the vegetable storage chamber 50 may easily wither to be damaged.

In order to solve such problem, as shown in FIG. 2, the conventional refrigerator is provided with a vegetable storage chamber having a sealing function. The vegetable storage chamber comprises a case 60 having an opening on a front surface thereof, and a drawer 70 accommodated in the case 70 in a withdrawable manner.

The case 60 is formed in shape of a rectangular parallelepiped of which front surface is open.

A plurality of ribs 62 protrude from an outer surface of the case 60. Under such configuration, transformation of the case 60 can be prevented.

A flange portion 63 is formed on the front surface of the case 60 so as to extend to outside.

The drawer 70 is provided with an accommodation portion 72 configured to accommodate food items therein, and a front portion 74 formed on a front surface of the accommodation portion 72.

The front portion 74 is formed to be contactable to the flange portion 63.

For an enhanced sealing function, a sealing member (gasket) 80 is provided at a contact region between the drawer 70 and the case 60.

A pump (vacuum pump) 73 configured to discharge air inside the case 60 to outside, and a connection pipe 75 are provided at one side of the case 60.

Once air inside the case 60 is discharged to outside by the pump 73, a depressurizing chamber is formed in the drawer 70 and the case 60. Under such configuration, food items stored in the drawer 70 can be stored for a long time in a more fresh state.

The case 60 and the drawer 70 may be formed of a metallic member (e.g., stainless). Under such configuration, when the inside of the case 60 is depressurized, transformation of the case 60 and the drawer 70 can be prevented.

The case 60 and the drawer 70 are formed of a metallic material, for prevention of transformation thereof when the inside of the case 60 and the drawer 70 is depressurized. This may cause a difficulty in fabricating the case 60 and the drawer 70, and may increase the fabrication costs.

In order to solve such problems, the case is formed of a synthetic resin member. However, in this case, the case may be transformed when being depressurized. Especially, an entrance region of the case may be transformed.

SUMMARY OF THE DISCLOSURE

Therefore, an aspect of the detailed description is to provide a refrigerator capable of preventing transformation of a case when the case is depressurized, and capable of being fabricated easily.

Another aspect of the detailed description is to provide a refrigerator capable of facilitating fabrication processes and assembly processes.

To achieve these and other advantages and in accordance with the purpose of this specification, as embodied and broadly described herein, there is provided a refrigerator, comprising: a refrigerator body having a cooling chamber; a case comprising a case body having therein an accommodation space of which one side is open, and a transformation preventing member formed of a material having a higher strength than that of the case body, the transformation preventing member provided at an open region of the case body and configured to prevent transformation of the case; a drawer accommodated in the case in a withdrawable manner; and a depressurizing device configured to depressurize inside of the drawer and the case to a pressure lower than an atmospheric pressure, when the drawer is accommodated in the case.

A flange portion, which extends to outside, may be provided at the open region of the case body, and the transformation preventing member may be disposed on a rear surface of the flange portion.

The transformation preventing member may be provided with a first part transformation preventing portion and a second part transformation preventing portion contacting each other in a facing manner in upper and lower directions.

One of the contact surfaces between the first part transformation preventing portion and the second part transformation preventing portion may be provided with a coupling protrusion which protrudes toward the other, and the other of the contact surfaces may be provided with a coupling protrusion accommodation portion configured to accommodate the coupling protrusion therein and engaged with the coupling protrusion.

The transformation preventing member may have an inserted injection molding so as to be inserted into a wall of the flange portion.

The refrigerator may further comprise a sealed state maintaining device comprising a locking portion provided at the case, and a coupling member movable to a sealing position for sealing inside of the case by compressing the sealing member by being coupled to the locking portion when the drawer is accommodated in the case, and movable to a releasing position for releasing the sealed state by being separated from the locking portion; and an adjusting member provided at the drawer, and configured to adjust the coupling member to move between the sealing position and the releasing position.

The refrigerator according to the present invention may have the following advantages.

Firstly, the case body may be provided with therein the accommodation space of which one side is open. And the transformation preventing member, formed of a material having a higher strength than that of the case body, may be provided at the open region of the case body. Under such configuration, when inside of the case is depressurized, transformation of the case can be prevented.

Secondly, as the case body is formed a material having a relatively low strength, fabrication processes of the case can be facilitated.

Thirdly, as the case body may be formed of a synthetic resin member and the transformation preventing member may be formed of a metallic member (stainless), fabrication processes of the case can be facilitated and fabrication costs can be reduced.

Fourthly, the case body may be formed of a synthetic resin member by injection molding, and the transformation preventing member may be coupled to a rear surface of the flange portion. This can facilitate fabrication processes and assembly processes.

Fifthly, the case body may be formed of a synthetic resin member by injection molding, and the transformation preventing member may be divided into a first part transformation preventing portion and a second part transformation preventing portion contacting each other in a facing manner in upper and lower directions. This can more facilitate fabrication processes and assembly processes.

Sixthly, the coupling protrusion and the coupling protrusion accommodation portion, engaged with each other, may be provided at contact surfaces between the first part transformation preventing portion and the second part transformation portion of the transformation preventing member. Under such configuration, when an external force is applied to the contact surfaces, the contact surfaces can be supported with a large force.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a refrigerator of the present invention will be explained in more detail with reference to the attached drawings.

Figure 1:
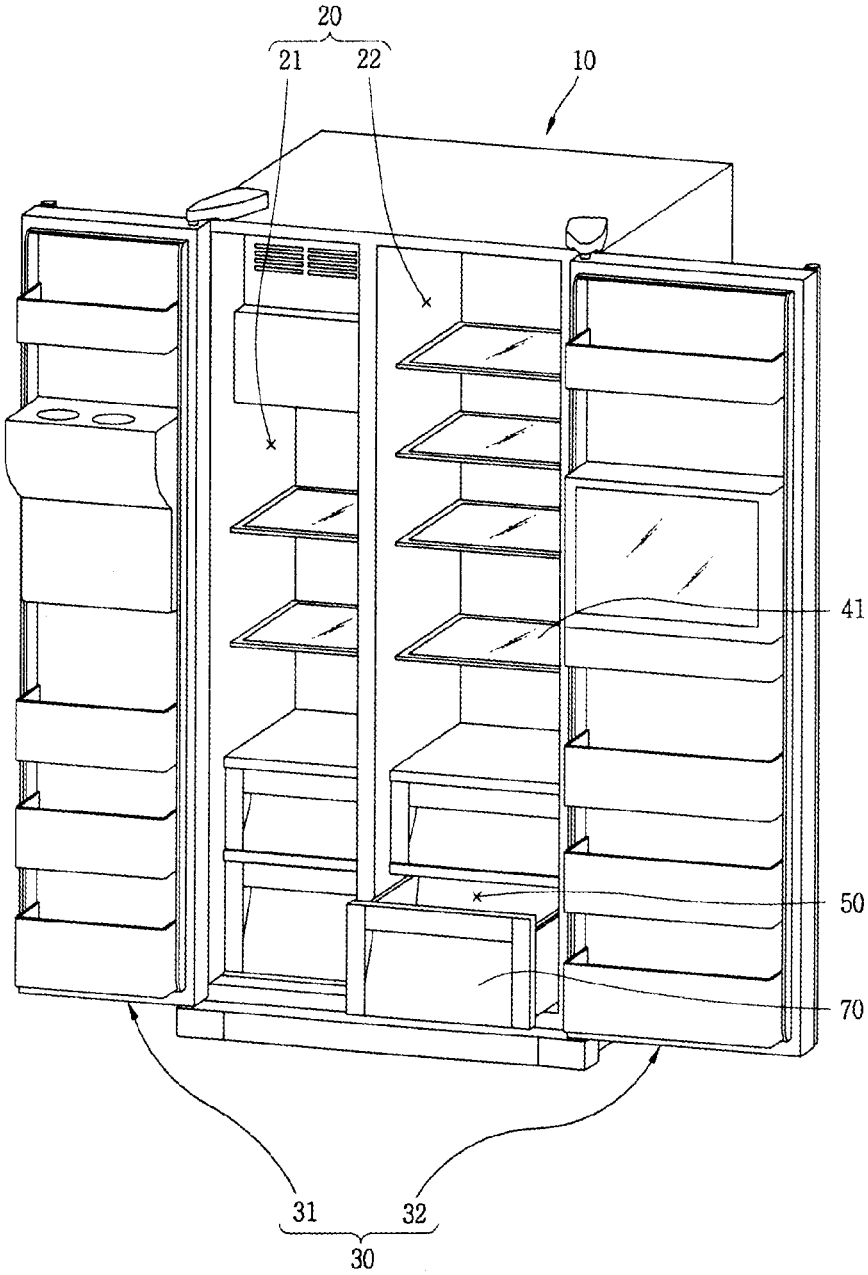
FIG. 1 is a perspective view illustrating an example of a refrigerator in accordance with the conventional art.
Figure 2:
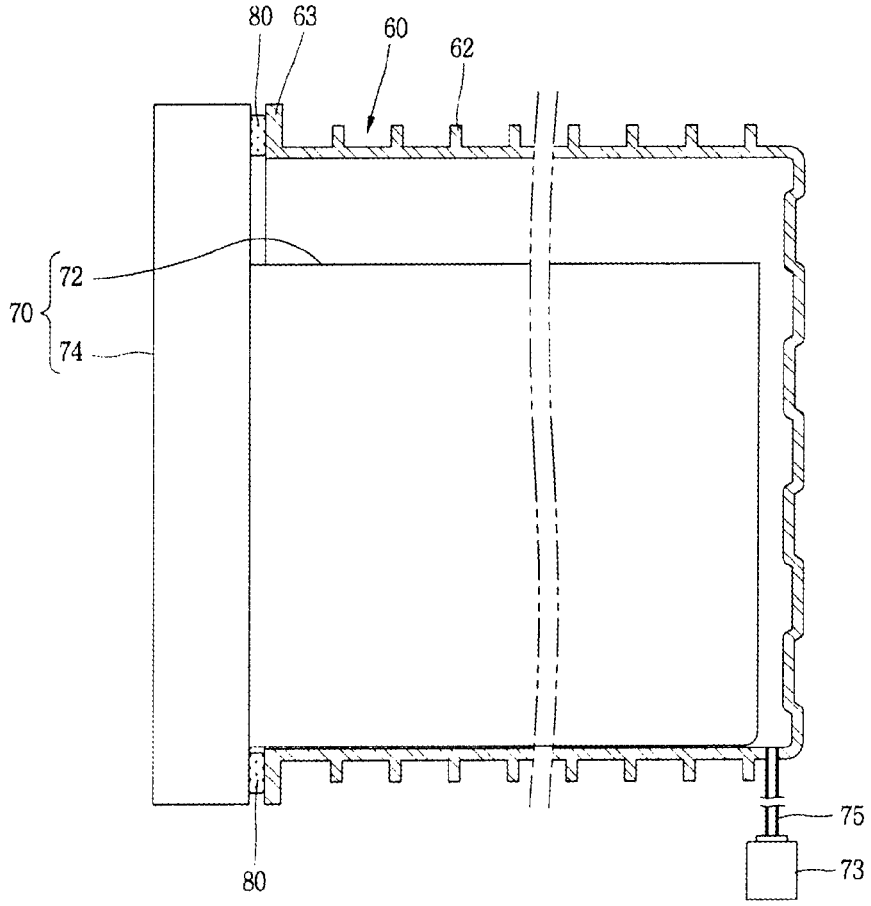
FIG. 2 is a sectional view of a vegetable storage chamber having a sealing function in accordance with the conventional art.
Figure 3:
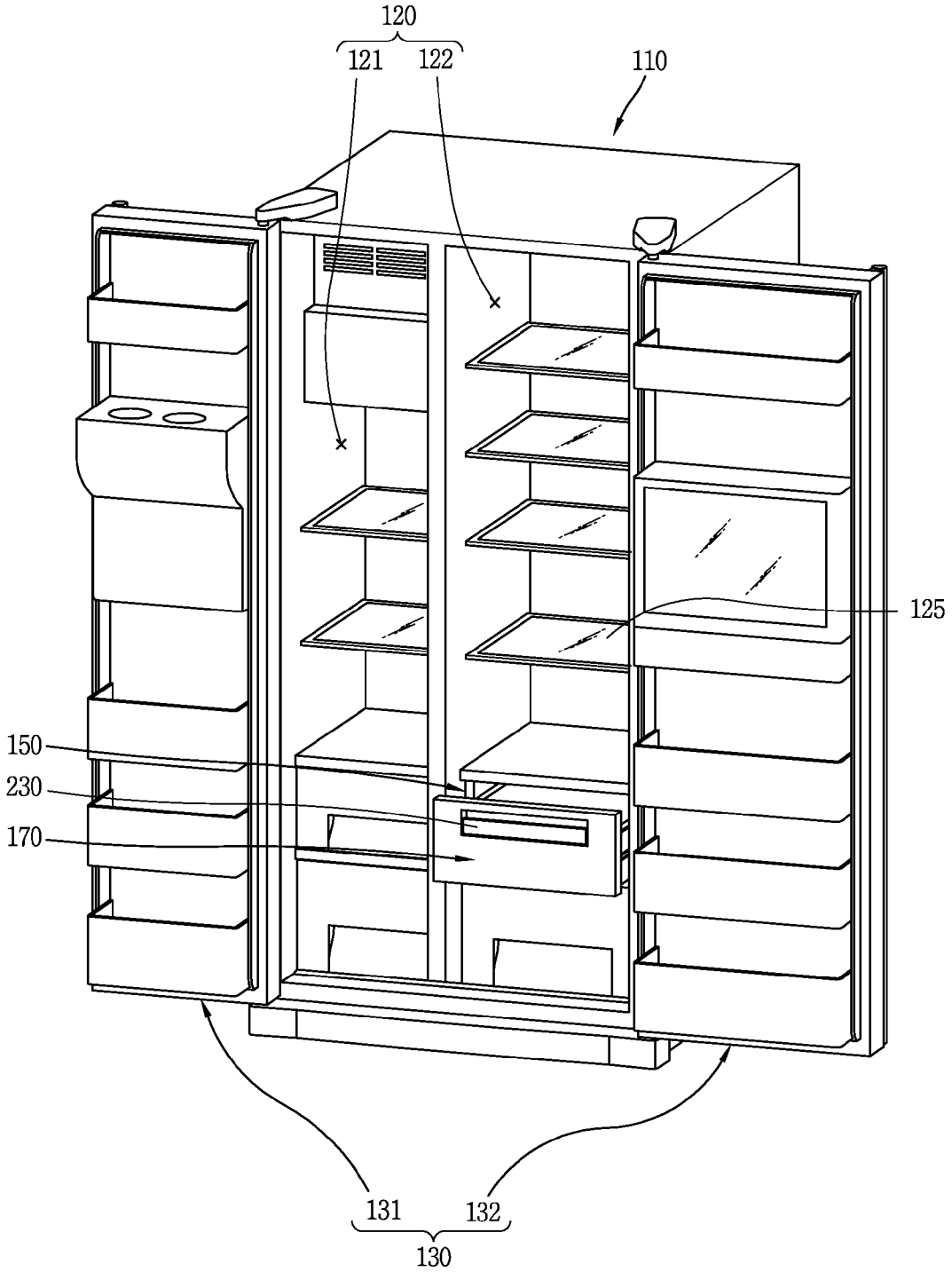
FIG. 3 is a perspective view of a refrigerator according to an embodiment of the present invention.
Figure 4:
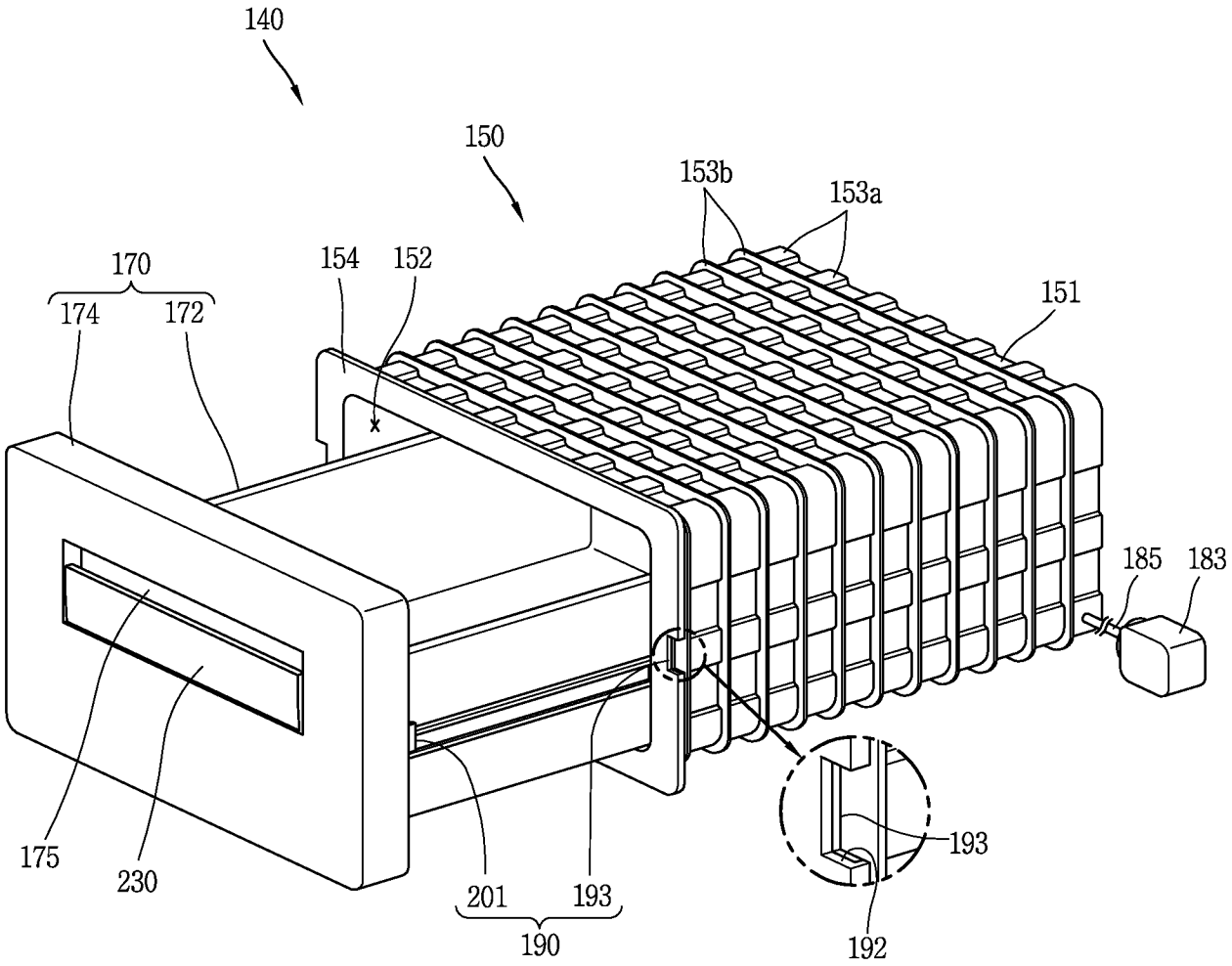
FIG. 4 is an enlarged perspective view of a case and a drawer of FIG. 3.
Figure 5:
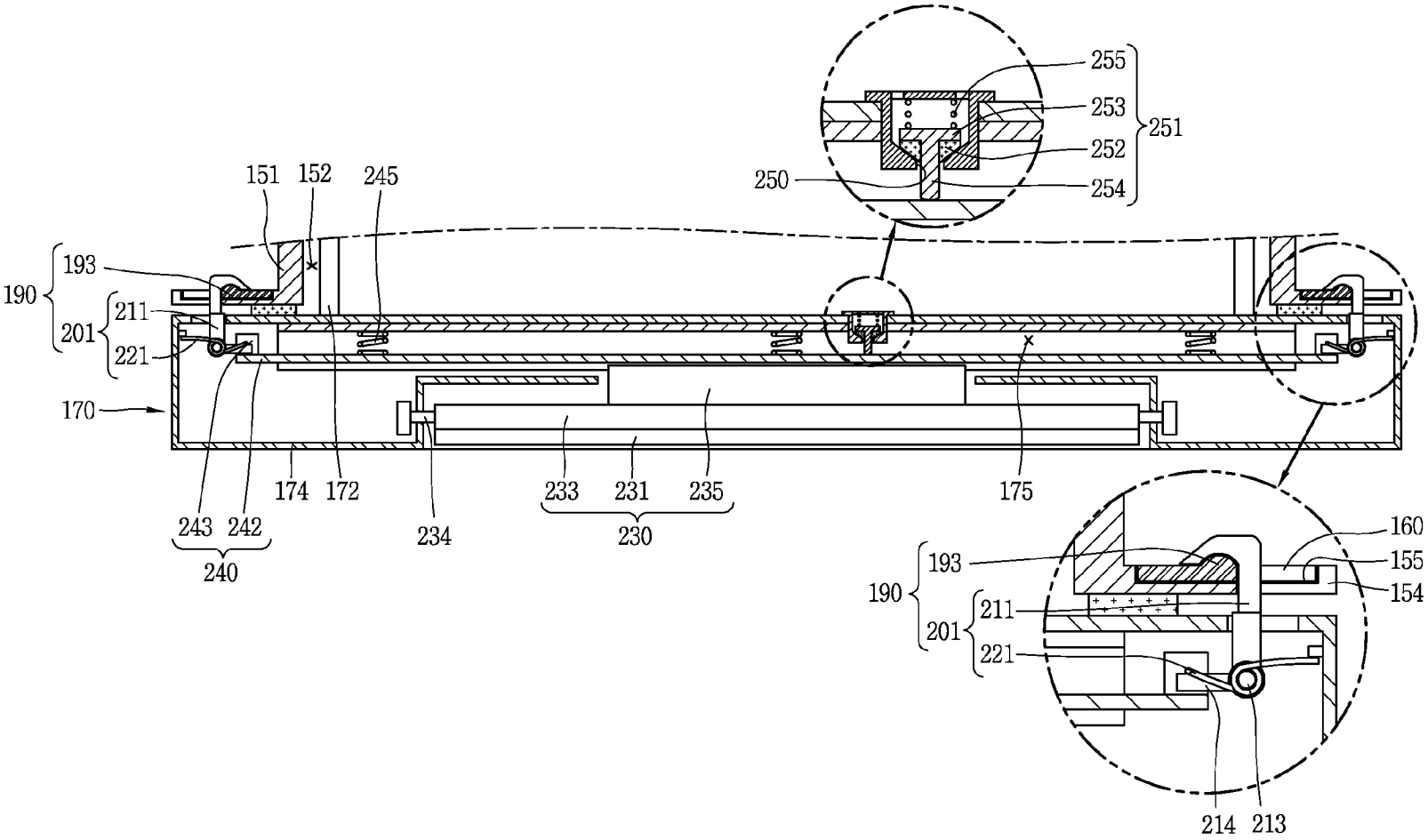
FIG. 5 is a partial planar sectional view illustrating a coupled state between a case and a drawer in FIG. 4.
Figure 6:
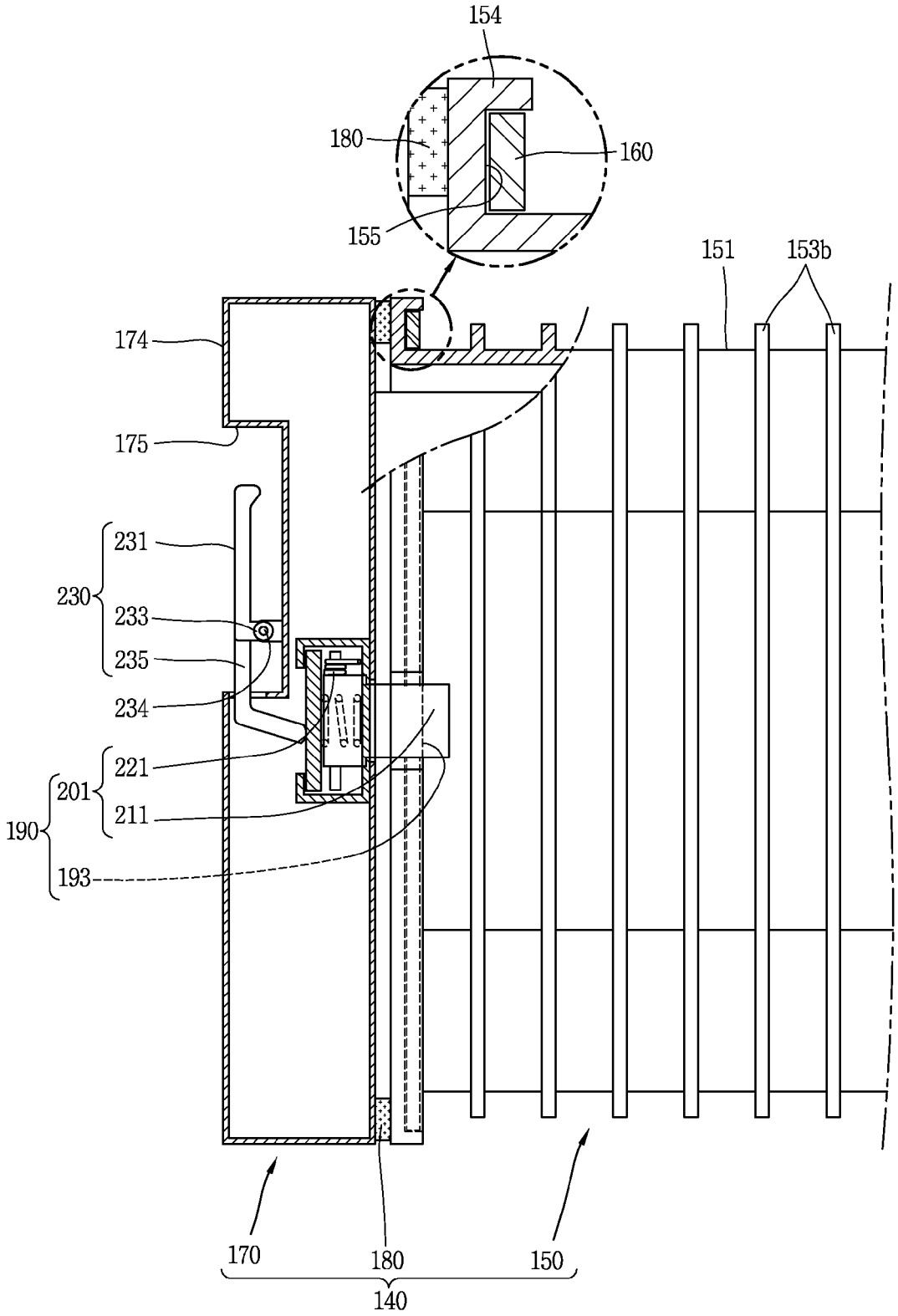
FIG. 6 is a partial side sectional view illustrating a coupled state between a case and a drawer in FIG. 4.
Figure 7:
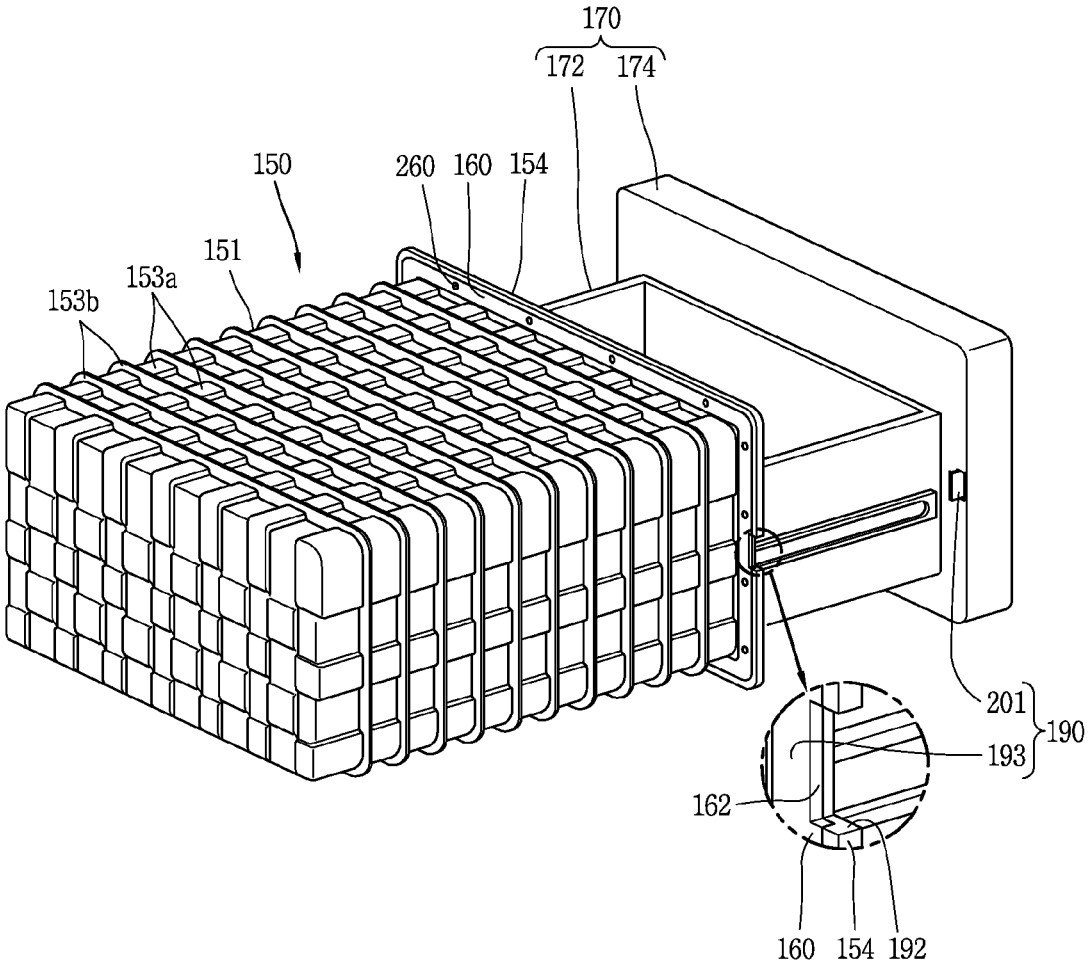
FIG. 7 is a perspective view illustrating a rear surface of a flange portion of FIG. 4.

As shown in FIGS. 3 to 5, a refrigerator according to an embodiment of the present invention comprises a refrigerator body 110 having a cooling chamber 120; a case 150 comprising a case body 151 having therein an accommodation space of which one side is open, and a transformation preventing member 160 formed of a material having a higher strength than that of the case body, the transformation preventing member provided at an open region of the case body 151 and configured to prevent transformation of the case; a drawer 170 accommodated in the case 150 in a withdrawable manner; and a depressurizing device 183 configured to depressurize inside of the drawer 170 and the case 150 to a pressure lower than the atmospheric pressure, when the drawer 170 is accommodated in the case 150. The cooling chamber 120 indicates a space for storing food items in a cooled state. The cooling chamber 120 may comprise a freezing chamber 121 and a refrigerating chamber 122. The refrigerator body 110 may comprise one of the freezing chamber 121 and the refrigerating chamber 122.

The cooling chamber 120 may be provided in the refrigerator body 110.

The refrigerator body 110 may be provided with a cooling chamber door 130 configured to open and close the cooling chamber 120.

The cooling chamber 120 may be formed in plurality.

The cooling chamber door 130 may be provided with a freezing chamber door 131 configured to open and close the freezing chamber 121, and a refrigerating chamber door 132 configured to open and close the refrigerating chamber 122.

A plurality of shelves 125, which is configured to partition an inner space of the refrigerating chamber 122 up and down, may be provided in the refrigerating chamber 122.

A depressurizing chamber 140, configured to depressurize inside of the refrigerating chamber 122 into a pressure lower than the atmospheric pressure, may be provided in the refrigerating chamber 122.

The depressurizing chamber 140 may comprise a case 150 of which one side is open, a drawer 170 accommodated in the case 150 in a withdrawable manner, and a sealing member 180 provided at a contact region between the case 150 and the drawer 170.

The case 150 may comprise a case body 151 having therein an accommodation space 152 of which one side is open, and a transformation preventing member 160 formed of a material having a higher strength than that of the case body, the transformation preventing member 160 provided at an open region of the case body 151 and configured to prevent transformation of the case.

The case 151 may be formed as a rectangular parallelepiped having therein the accommodation space 152 of which one side is open.

A flange portion 154, which extends to outside along the edge of the open region, may be provided at the case body 151.

A plurality of protrusions (beads) 153*a* may be formed on an outer surface of the case body 151.

The protrusions 153*a* may be disposed in a lengthwise direction of the case body 151. Under such configuration, transformation of the case body 151 can be prevented.

A plurality of ribs 153*a*, which protrudes to outside and extends in a circumferential direction, may be formed on an outer surface of the case body 151. Under such configuration, transformation of the case body 151 can be prevented.

The drawer 170 may be provided with an accommodation portion 172 configured to accommodate food items therein, and a front portion 174 formed on a front surface of the accommodation portion 172.

The front portion 174 may be formed to be contactable to the flange portion 154.

A sealing member 180 may be provided at a contact region between the drawer 170 and the case 150. Under such configuration, when the drawer 170 is accommodated in the case 150, the contact region between the drawer 170 and the case 150 can be sealed.

The sealing member 180 may be formed of a rubber member.

The sealing member 180 may be formed in shape of a closed loop contactable to the flange portion 154.

A depressurizing device 183 (e.g., vacuum pump), configured to depressurize inside of the case 150, may be provided at one side of the case 150.

A connection pipe 185, configured to connect inside of the depressurizing device 183 to inside of the case 150, may be provided between the depressurizing device 183 and the case 150.

A sealed state maintaining device 190, configured to maintain a sealed state of an inner space of the case 150 and the drawer 170, when the drawer 170 has been accommodated in the case 159, may be provided at the drawer 170 and the case 150.

The sealed state maintaining device 190 may comprise a locking portion 193 provided at the case 150, and a coupling member 201 movable to a sealing position for sealing inside of the case by compressing the sealing member by being coupled to the locking portion 193 when the drawer 170 is accommodated in the case 150, and movable to a releasing position for releasing the sealed state by being separated from the locking portion 193.

As shown in FIG. 5, the coupling member 201 may comprise a hook 211 which rotates about a rotation shaft 213 disposed in upper and lower directions, and a hook spring 221 configured to provide an elastic force to the hook 211 so that the hook 211 can rotate to the sealing position.

An arm 214 may be provided at one side of the hook 211. The arm 214 may be integrally formed with the hook 211, so that the hook 211 can rotate together when the arm 214 rotates.

The hook 211 may be formed in plurality.

The hook 211 may be formed in two, and may be provided at two sides of the front portion 174 of the drawer 170.

The locking portion 193 may be formed by cutting the flange portion 154.

The locking portions 193 may be formed at center parts of two side surfaces of the flange portion 154, so as to be engaged with the hooks 211.

A hook spring 221, configured to provide an elastic force to the hook 211 so that the hook 211 can rotate to a sealing position, may be provided at the rotation shaft 213 of the hook 211.

The hook spring 221 may be coupled to the rotation shaft 213 of the hook 211.

When the drawer 170 is accommodated in the case 150, the hook 211 and the locking portion 193 may be engaged with each other in a state where the sealing member 180 has been compressed by a compression force applied to the drawer 170. Under such configuration, the compressed state of the sealing member 180 can be maintained.

An adjusting member 230, configured to release an engaged state between the coupling member 201 and the locking portion 193, may be provided at the drawer 170.

The adjusting member 230 may be rotatably provided at the drawer 170.

The adjusting member 230 may be configured to be downward rotatable.

An adjusting member accommodation portion 175, configured to accommodate the adjusting member 230 in a rotatable manner, may be provided at the drawer 170.

An operation bar 240, configured to rotate the hook 211 to a releasing position by transmitting a driving force to the hook 211 when the adjusting member 230 is pulled, may be provided between the adjusting member 230 and the hook 211.

The operation bar 240 may be provided with an operation bar body 242 having a long plate shape, and a pressurizing end portions 243 formed at two ends of the operation bar body 242 and configured to pressurize the hook 211.

An elastic member 245, configured to pressurize the operation bar 240 to a releasing position, may be provided at a rear side of the operation bar 240. Under such configuration, the operation bar 240 and the adjusting member 230 may be moved to the initial position (sealing position).

The adjusting member 230 may comprise a plate portion 231 having a long plate shape, a rotation shaft accommodation portion 233 provided on a rear surface of the plate portion 231, and a pressurizing portion 235 extending from the rotation shaft accommodation portion 233 in a different direction from the plate portion 231, and configured to pressurize the operation bar 240.

A communication portion 250, configured to communicate inside and outside of the drawer 170 with each other, may be provided at the drawer 170.

An opening/closing member 251, configured to open and close the communication portion 250, may be provided at the communication portion 250.

The opening/closing member 251 may comprise an elastic portion 252 configured to open and close the communication portion 250, a supporting portion 253 configured to support the elastic portion 252, an operation rod 254 protruding from the supporting portion 253, and a spring 255 configured to provide an elastic force to the supporting portion 253 so that the supporting portion 253 can approach to the communication portion 250.

The operation rod 254 may be configured to contact the operation bar 240 by passing through the communication portion 250. Under such configuration, when the operation bar 240 moves to a releasing position, the elastic portion 252 is spaced from the communication portion 250 by being pressurized by the operation bar 240, to thus open the communication portion 250.

A mounting portion 155, configured to mount the transformation preventing member 160, may be formed at the flange portion 154.

The transformation preventing member 160 may be provided on a rear surface of the flange portion 154.

The mounting portion 155 may be concaved from the rear surface of the flange portion 154 in a thickness direction.

The case body 151 may be formed of a synthetic resin member, and the transformation preventing member 160 may be formed of a metallic member, e.g., a stainless steel member.

The case body 151 may be formed by injection molding.

The transformation preventing member 160 may be formed in a closed loop shape in correspondence to the flange portion 154.

A cut-out portion 162, cut-out so as to be engaged with the hook 211, may be formed at two side walls of the transformation preventing member 160.

The case 150 and the transformation preventing member 160 may be provided with a fixing means configured to fix the transformation preventing member 160 when the transformation preventing member 160 is coupled to the mounting portion 155.

Figure 8:
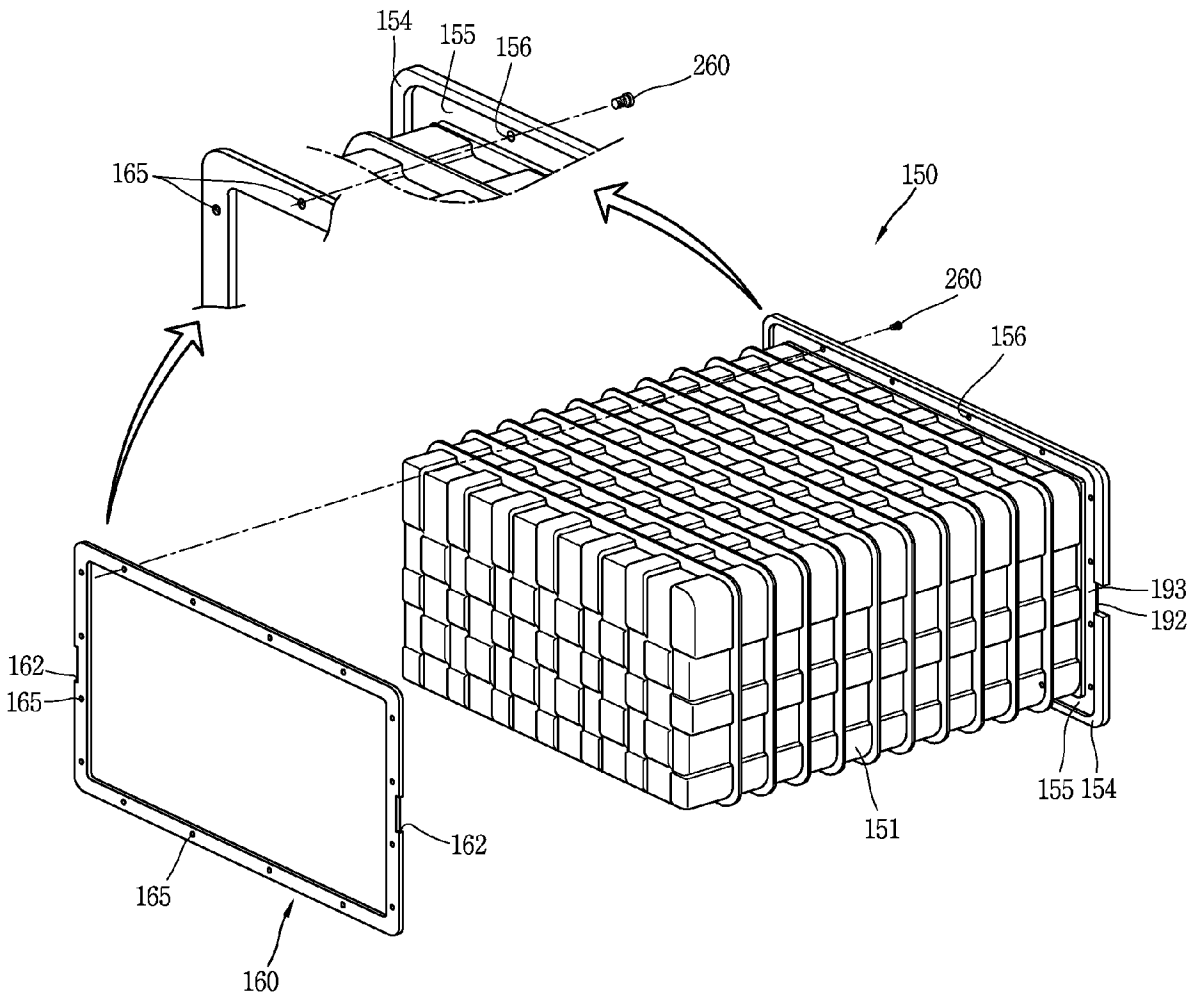
FIG. 8 is a perspective view before a coupled state of a transformation preventing member of FIG. 7.
Figure 9:
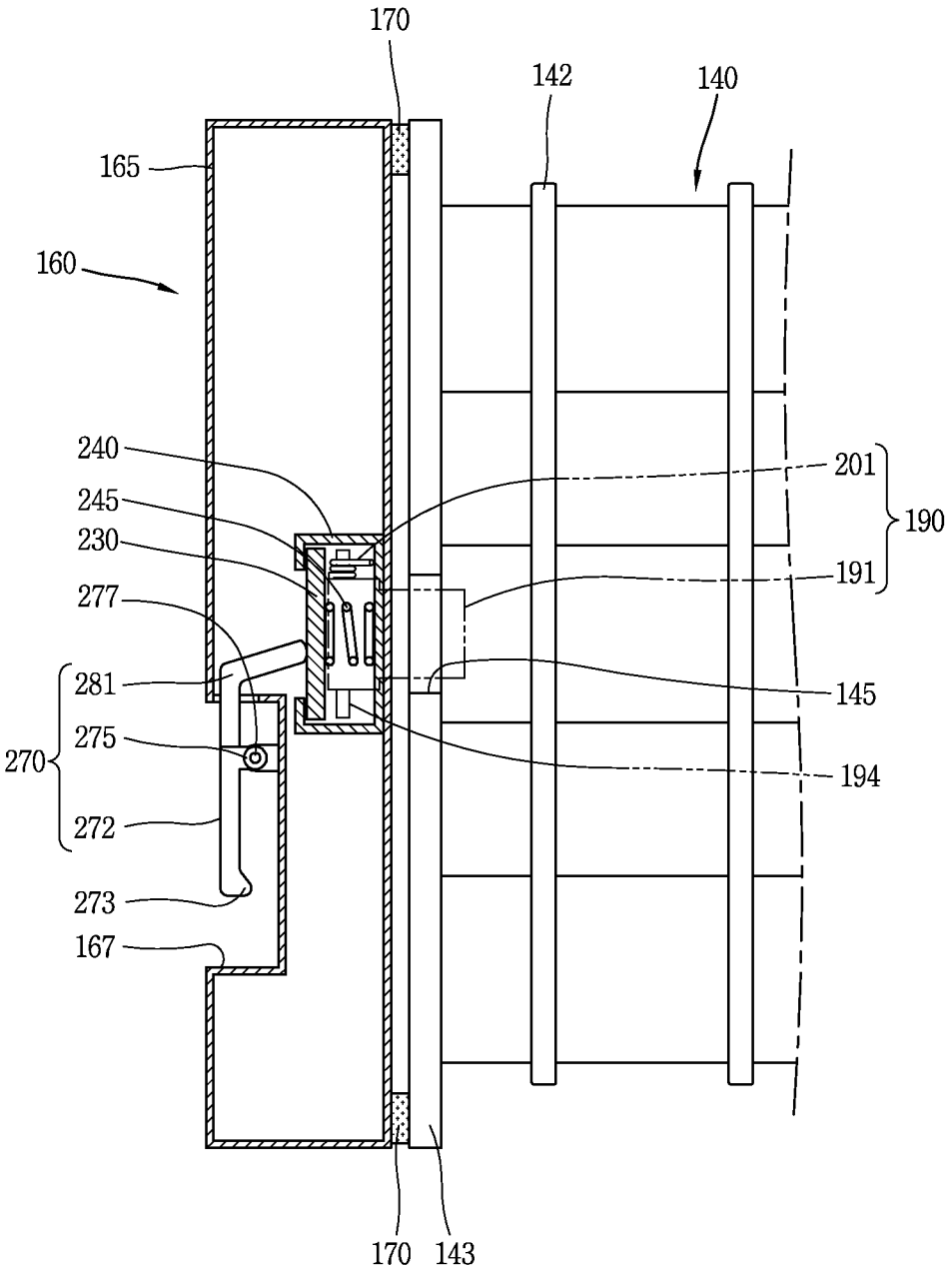
FIG. 9 is an enlarged sectional view illustrating a coupled state of a coupling member of FIG. 8.

As shown in FIGS. 8 and 9, the fixing means may comprise a coupling member 260 coupled to a female screw portion 165 by passing through the case 150, and the female screw portion 165 formed at the transformation preventing member 160 so as to screw-couple the coupling member 260 thereto.

A coupling member inserting hole 156, configured to insert the coupling member 260 therein, may be penetratingly-formed at the flange portion 154.

The coupling member inserting hole 156 may be provided with an extension portion 157 configured to accommodate a head of the coupling member 260 therein.

Figure 10:
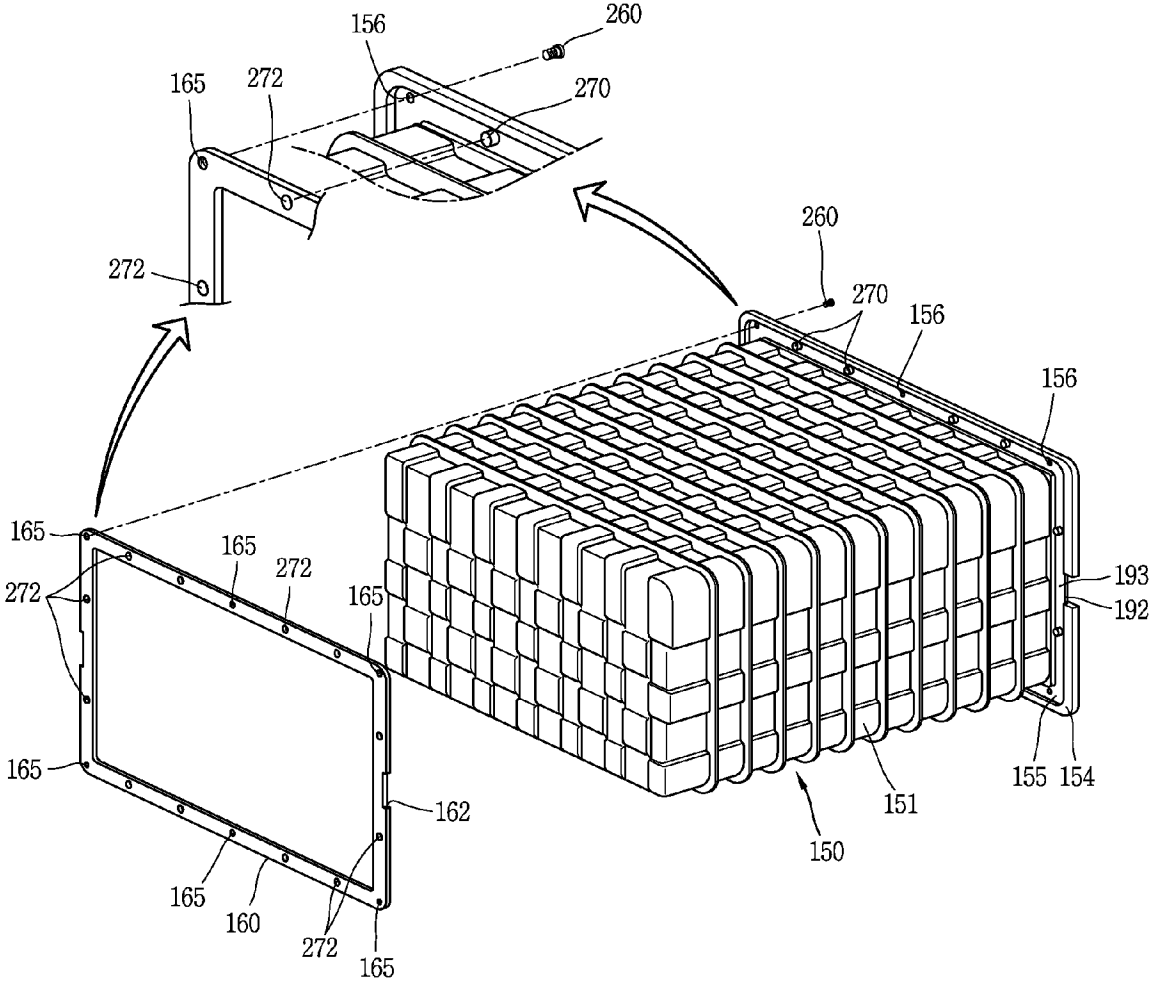
FIG. 10 is an exploded perspective view of a case of FIG. 4 according to a modification example.
Figure 11:
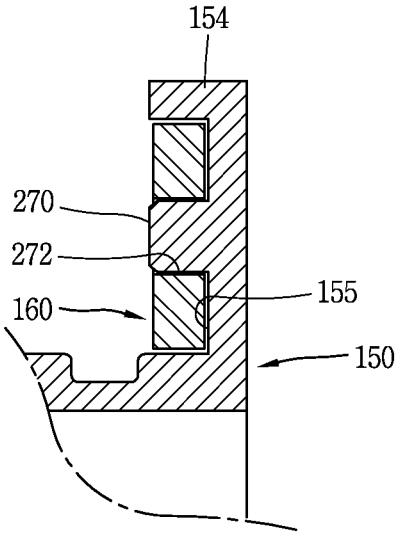
FIG. 11 is an enlarged sectional view of a protruding region of FIG. 10.

As shown in FIGS. 10 and 11, the fixing means may further comprise protrusion portions 270 protruding from one of contact surfaces between the flange portion 154 and the transformation preventing member 160 toward the other, and accommodation portions 272 formed at the other of the contact surfaces and configured to accommodate the protrusion portions 270 therein.

More specifically, the protrusion portions 270 may protrude from the mounting portion 155.

The transformation preventing member 160 may be provided with the plurality of accommodation portions 272 configured to accommodate the protrusion portions 270 therein.

The fixing means may comprise the protrusion portions 270, the accommodation portions 272, coupling members 260 coupled to female screw portions 165 by passing through the flange portion 154 of the case 150, and the female screw portions 165 formed at the transformation preventing member 160 so as to be screw-coupled to the coupling members 260.

Figure 12:
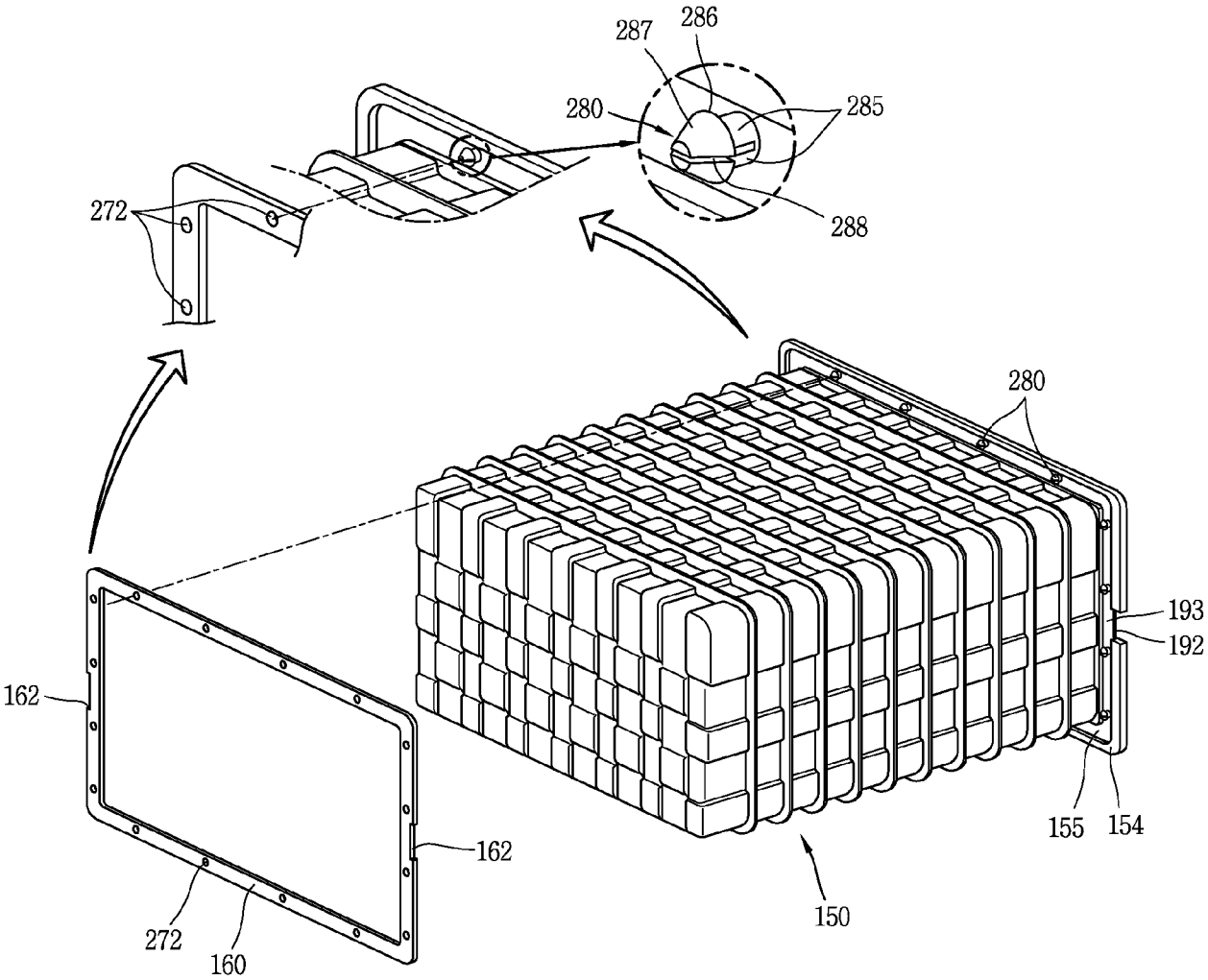
FIG. 12 is a view illustrating a case of FIG. 4 according to another modification example.
Figure 13:
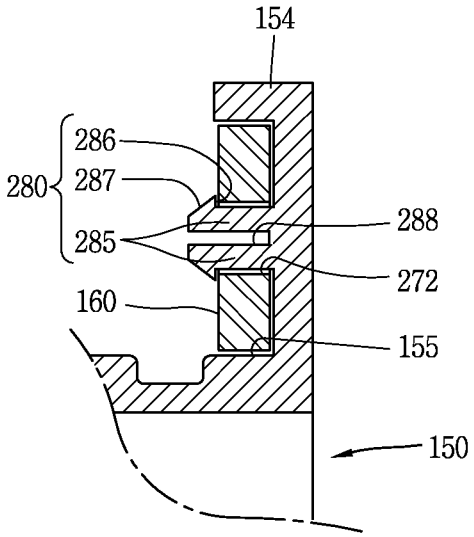
FIG. 13 is a sectional view illustrating a coupled state of a hook of FIG. 12.

As shown in FIGS. 12 and 13, the fixing means may comprise a protrusion portion 280 protruding from one of contact surfaces between the flange portion 154 and the transformation preventing member 160 toward the other, and accommodation portions 272 formed at the other of the contact surfaces and configured to accommodate the protrusion portions 280 therein. The protrusion portions 280 may be provided with a plurality of elastic transformation portions 285 cut-out so as to be elastically-transformed with its decreased outer width.

A cut-out slit 288 may be formed between the elastic transformation portions 285.

The elastic transformation portion 285 of the protrusion portion 280 may be provided with a locking slit 286 configured to prevent the transformation preventing member 160 coupled thereto from being separated therefrom.

A guiding surface 287 may be formed on an outer surface of each locking slit 286. The guiding surface 287 may be formed so that its thickness can be gradually decreased toward a protruding direction of the elastic transformation portion 285. Under such configuration, when each elastic transformation portion 285 is coupled to the accommodation portion 272, the elastic transformation portion 285 is elastically transformed toward its center so that its outer width can be decreased. This can facilitate the coupling process of the elastic transformation portion 285.

Under such configuration, when the drawer 170 is to be accommodated in the case 150, the front portion 174 of the drawer 170 is pressurized toward the case 150.

Once the drawer 170 is accommodated in the case 150, the sealing member 180 may contact the flange portion 154.

Once the front portion 174 of the drawer 170 moves close to the flange portion 154 of the case 150, the guiding surface 287 of the hook 211 may contact the locking portion 193 to thus rotate to be widened toward outside.

If the drawer 170 continuously moves, the sealing member 180 is compressed and the end of the guiding surface 287 passes through the locking portion 193 (substantially, a vertical section of the cut-out portion 162 of the transformation preventing member 160). As a result, the hook 211 rotates to a sealing position by an elastic force of the hook spring 221, thereby being engaged with the locking portion 193. Under such configuration, the compressed state of the sealing member 180 can be maintained.

Once the drawer 170 is completely accommodated in the case 150, an inner pressure of the case 150 may be lowered to a preset value lower than the atmospheric pressure, by the depressurizing device 183.

The open region of the case 150, having no side wall and having a relatively low strength, has its strength reinforced by the flange portion 154 and the transformation preventing member 160. As a result, the case 150 can be prevented from being transformed when depressurized.

When the drawer 170 is to be withdrawn from the case 150, the adjusting member 230 is pulled toward the front side.

If the adjusting member 230 is pulled, the adjusting member 230 may rotate about the rotation shaft, and the operation bar 240 may move to a releasing position by the pressurizing portion 235. As the opening/closing member 251 pressurized by the operation bar 240 is spaced from the communication portion 250, the communication portion 250 is open. Under such configuration, external air is introduced into the case 150 to thus release a vacuum state.

The operation bar 240 pressurizes the hook 211 while moving to a releasing position. As a result, the hook 211 rotates to the releasing position, and an engaged state between the hook 211 and the locking portion 193 is released.

Once the engaged state between the hook 211 and the locking portion 193 is released, the drawer 170 can be withdrawn toward the front side.

Hereinafter, a refrigerator according to another embodiment of the present invention will be explained with reference to FIG. 14.

The same components as those of the aforementioned embodiment will be provided with the same reference numerals.

The same configuration as that of the aforementioned embodiment will not be explained for convenience.

Figure 14:
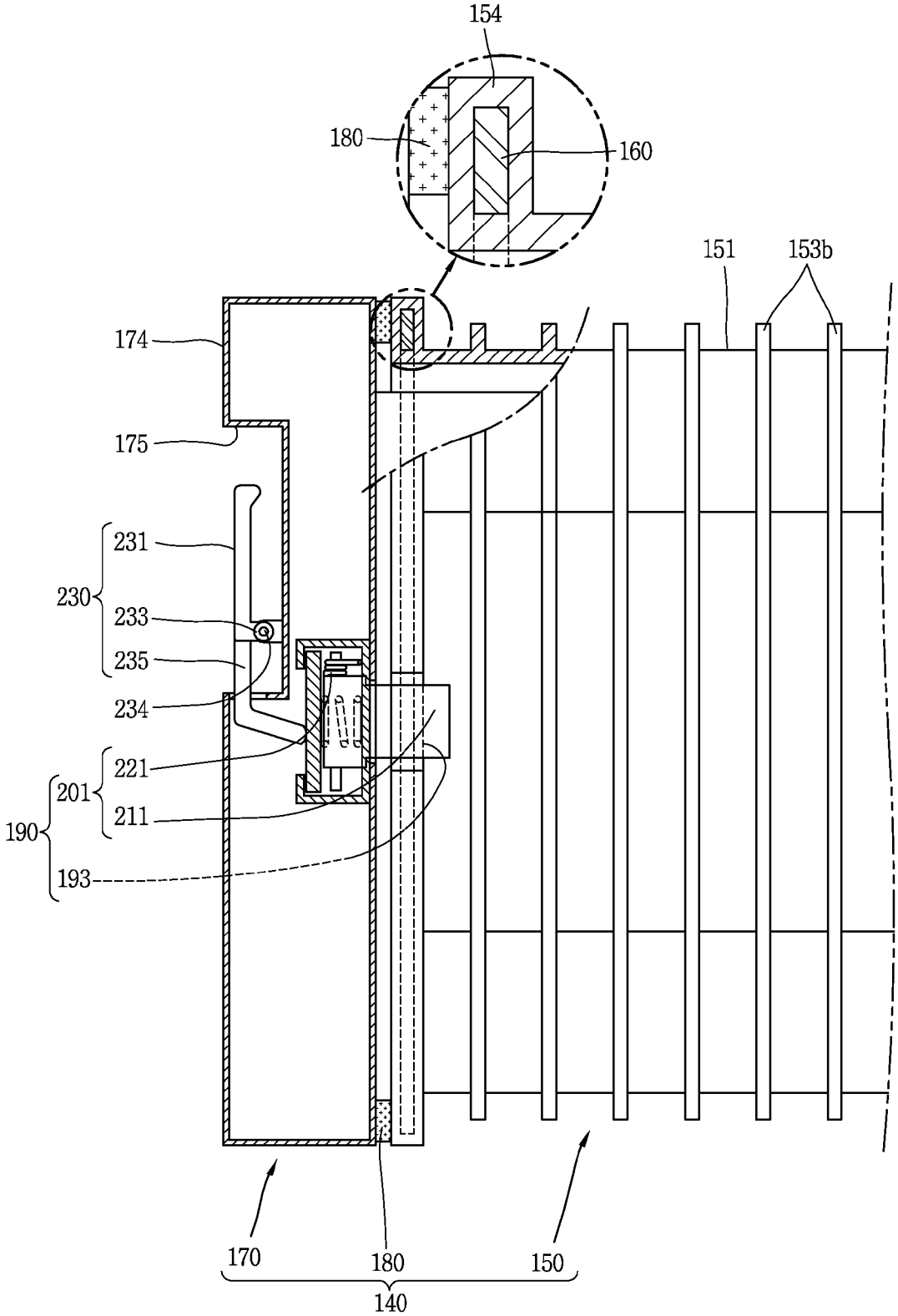
FIG. 14 is a partial side sectional view illustrating a refrigerator according to another embodiment of the present invention.

As shown in FIG. 14, a refrigerator according to another embodiment of the present invention comprises a case 150 comprising a case body 151 having therein an accommodation space of which one side is open, and a transformation preventing member 160 formed of a material having a higher strength than that of the case body 151, the transformation preventing member 160 provided at an open region of the case body 151 and configured to prevent transformation of the case.

The case body 151 may be formed of a synthetic resin member, and a flange portion 154 which extends to outside may be formed at the open region.

The transformation preventing member 160 may be formed of a metallic member, e.g., a stainless member.

The transformation preventing member 160 is disposed in the flange portion 154 of the case body 151.

More specifically, the transformation preventing member 160 may be formed so that its outer surface can be completely covered by the flange portion 154.

The transformation preventing member 160 may be formed in a close-loop shape in correspondence to the flange portion 154 of the case body 151. However, the transformation preventing member 160 may be formed to have a length, a width and a thickness decreased than those of the flange portion 154, so as to be inserted into the flange portion 154.

More specifically, the transformation preventing member 160 may be formed by inserted injection molding when the case body 151 is formed by injection molding. Under such configuration, a subsequent assembly process for assembling the transformation preventing member 160 to the rear surface of the flange portion 154 is omitted. This can facilitate fabrication processes.

When the drawer 170 is to be accommodated in the case 150, the drawer 170 is pressurized toward the case 150. Once the drawer 170 is accommodated in the case 150, the sealing member 180 is compressed, and the hook 211 is engaged with the locking portion 193 so that the compressed state of the sealing member 180 can be maintained.

Once the drawer 170 is accommodated in the case 150, the sealed inside of the drawer 170 and the case 150 can be depressurized by the depressurizing device 183. The transformation preventing member 160, inserted into the flange portion 154, can prevent transformation of the open region of the case body 151 having a relatively low strength.

A refrigerator according to another embodiment of the present invention will be explained with reference to FIGS. 15 to 17.

Figure 15:
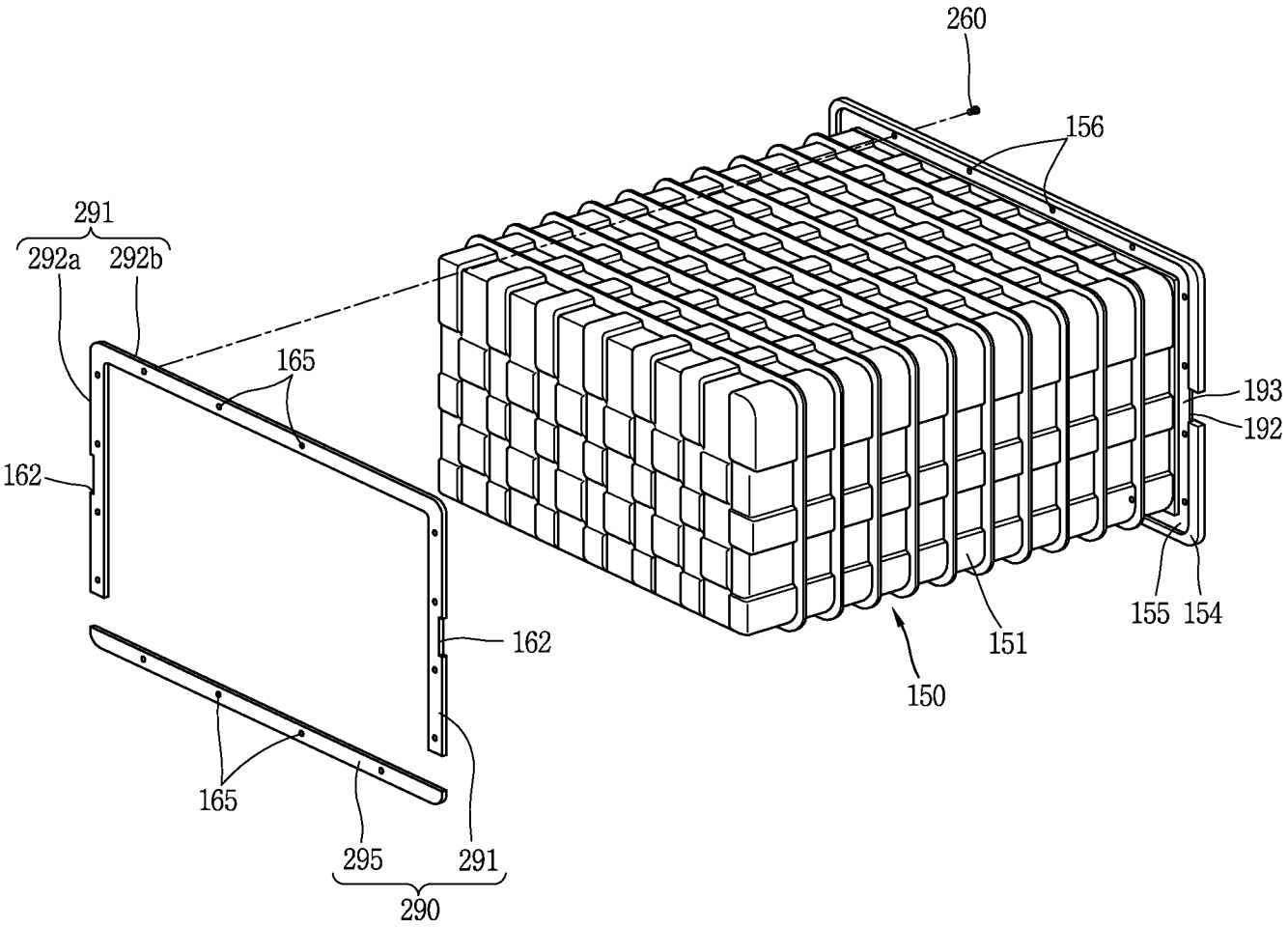
FIG. 15 is a perspective view illustrating a state before a transformation preventing member and a case are coupled to each other in a refrigerator according to another embodiment of the present invention.

As shown in FIG. 15, a refrigerator according to another embodiment of the present invention comprises a case 150 comprising a case body 151 having therein an accommodation space of which one side is open, and a transformation preventing member 290 formed of a material having a higher strength than that of the case body 151, the transformation preventing member 290 provided at an open region of the case body 151 and configured to prevent transformation of the case.

The case body 151 may be formed of a synthetic resin member, and the transformation preventing member 290 may be formed of a stainless member.

A flange portion 154 may be provided at the open region of the case body 151.

A mounting portion 155, configured to mount the transformation preventing member 290, may be formed on a rear surface of the flange portion 154.

The transformation preventing member 290 may be provided with a first part transformation preventing portion 291 and a second part transformation preventing portion 295 contacting each other in a facing manner in upper and lower directions. The first part transformation preventing portion 291 and the second part transformation preventing portion 295 can be separately coupled to the mounting portion 255. This can facilitate a coupling operation to couple the transformation preventing member 290 to the mounting portion 255.

The first part transformation preventing portion 291 may be provided with a horizontal section 292*b* horizontally disposed above the case body 151, and vertical sections 292*a* downward bent from two ends of the horizontal section 292*b*. The second part transformation preventing portion 295 may be horizontally disposed below the case body 151.

Each vertical section 292*a* may be provided with the cut-out portion 162 cut-out in correspondence to a cut-out portion 192 and the locking portion 193.

The mounting portion 155 may be formed on a rear surface of the flange portion 154.

The mounting portion 155 may be concaved from the rear surface of the flange portion 154 in a thickness direction.

The case 150 and the transformation preventing member 290 may be provided with a fixing means configured to fix the transformation preventing member 290 when the transformation preventing member 290 is coupled to the mounting portion 155.

The fixing means may comprise a coupling member 260 coupled to a female screw portion 165 by passing through the case 150, and the female screw portion 165 formed at the transformation preventing member 160 so as to screw-couple the coupling member 260 thereto.

A coupling member inserting hole 156 may be penetratingly-formed at the flange portion 154 of the case 150.

The coupling member inserting hole 156 may be provided with an extension portion configured to accommodate a head of the coupling member 260 therein.

Figure 16:
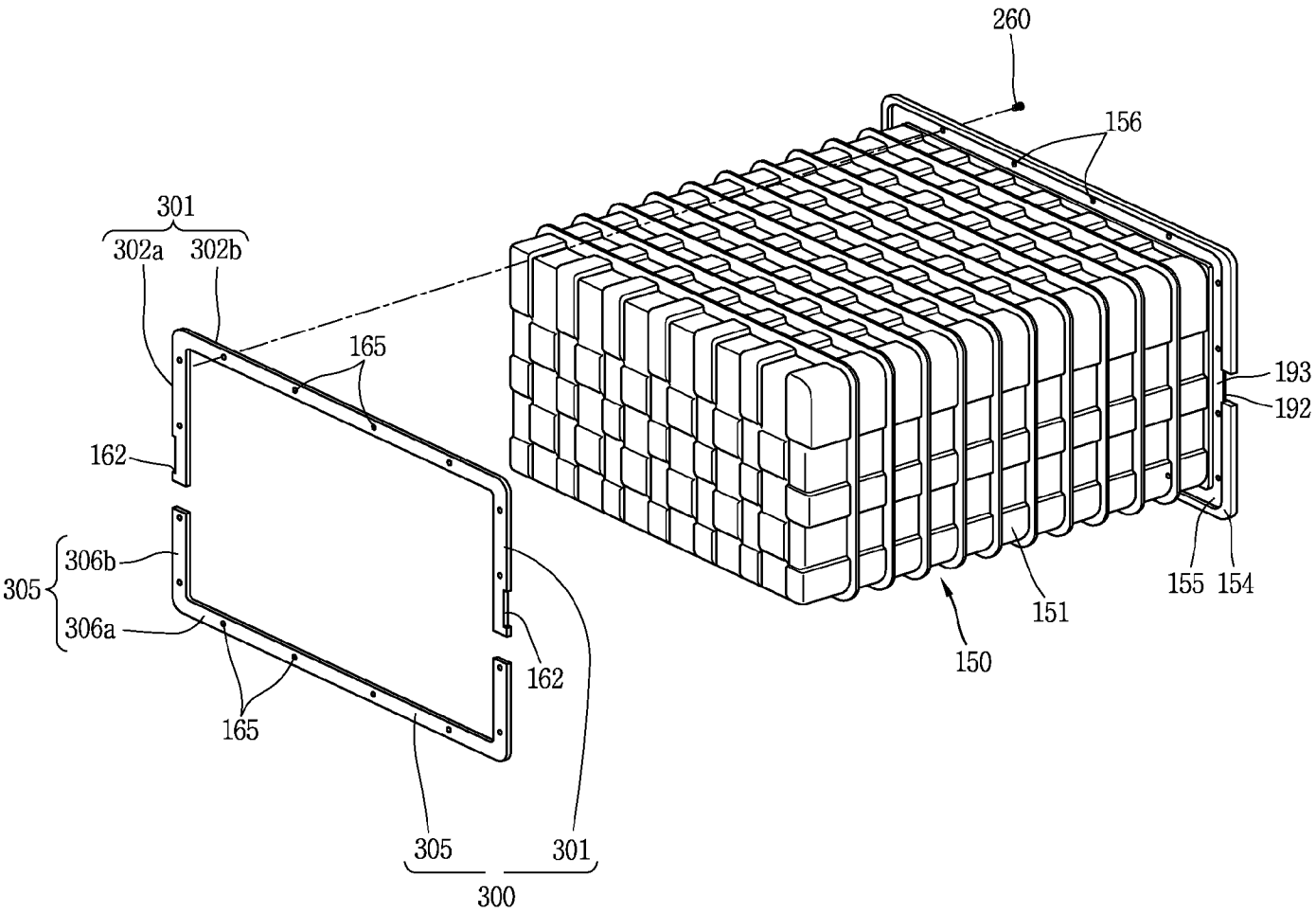
FIG. 16 is a perspective view illustrating a state before a transformation preventing member and a case are coupled to each other in a refrigerator according to another embodiment of the present invention.

As shown in FIG. 16, the case 150 according to another embodiment of the present invention may comprise a transformation preventing member 300 having a first part transformation preventing portion 301 and a second part transportation preventing portion 305.

The first part transformation preventing portion 301 may be provided with a horizontal section 302*b* horizontally disposed above the case body 151, and vertical sections 302*a* downward bent from two ends of the horizontal section 302*b*.

The second part transformation preventing portion 305 may be provided with a horizontal section 306*b* horizontally disposed below the case body 151, and vertical sections 306*a* upward bent from two ends of the horizontal section 306*b*.

The vertical section 302*a* of the first part transformation preventing portion 301, and the vertical section 306*a* of the second part transformation preventing portion 305 may have their lengths to be controlled properly.

An engaging portion 307 may be provided at a contact surface between the first part transformation preventing portion 301 and the second part transformation preventing portion 305. Under such configuration, a coupling force between the first part transformation preventing portion 301 and the second part transformation preventing portion 305 can be increased.

The engaging portion 307 may comprise a coupling protrusion 308 protruding from one of contact surfaces between the first part transformation preventing portion 301 and the second part transformation preventing portion 305 toward the other, and a coupling protrusion accommodation portion 309 formed at the other of the contact surfaces in a concaved manner and configured to accommodate the coupling protrusion 308 therein.

Figure 17:
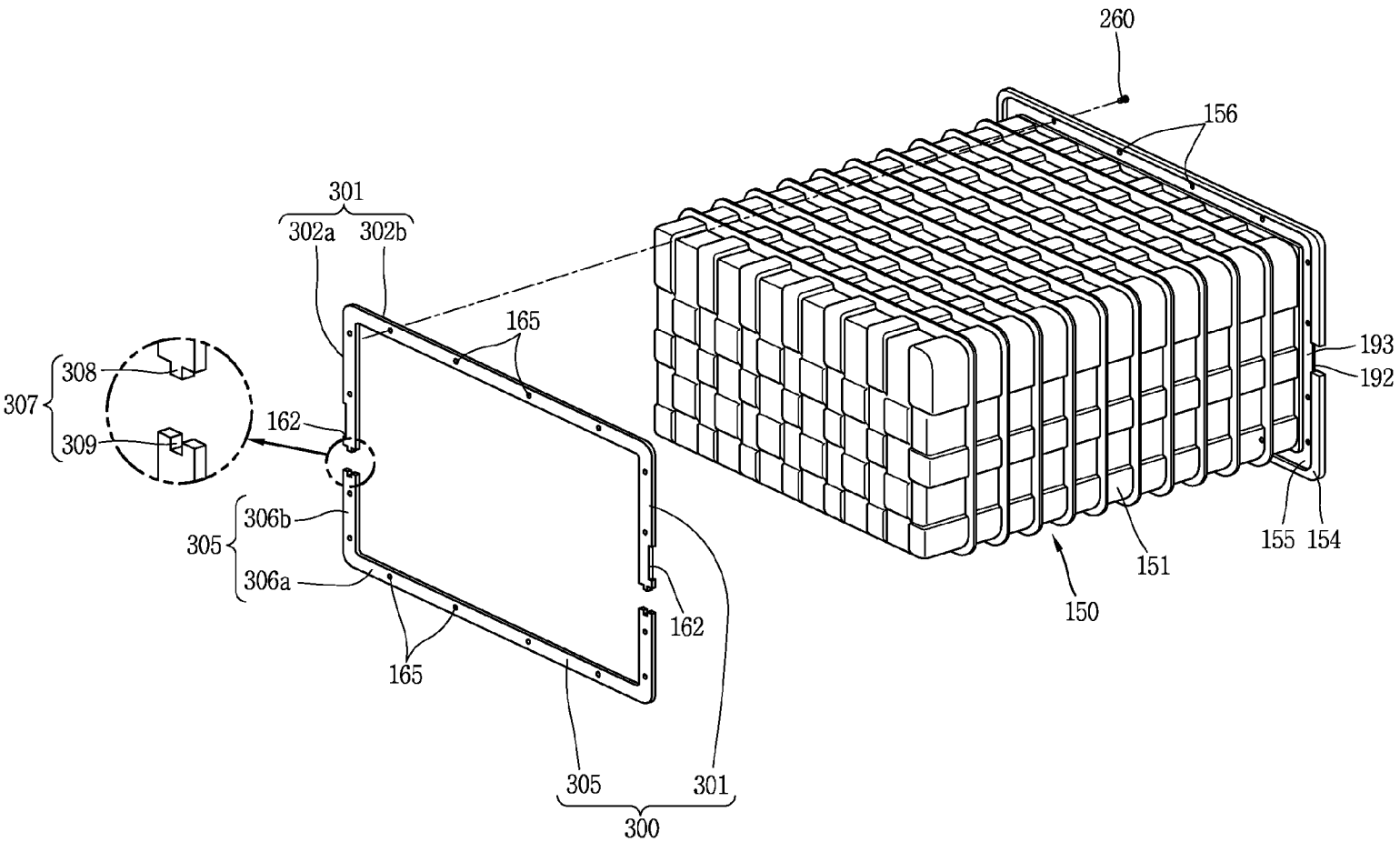
FIG. 17 is a view illustrating a modification example of the transformation preventing member of FIG. 16.

As shown in FIG. 17, the coupling protrusion 308 may protrude downward from the vertical section 302*a* of the first part transformation preventing portion 301.

The coupling protrusion accommodation portion 309 may be concaved from an upper end of the vertical section 306*a* of the second part transformation preventing portion 305.

The female screw portion 165, configured to screw-couple the coupling member 260 thereto, may be formed at each of the first part transformation preventing portion 301 and the second part transformation preventing portion 305.

Under such configuration, when the drawer 170 is to be accommodated in the case 150, the front portion 174 of the drawer 170 is pressurized toward the case 150.

Once the drawer 170 is accommodated in the case 150, the sealing member 180 may contact the flange portion 154 thus to be compressed. And the hook 211 and the locking portion 193 are engaged with each other so that a sealed state of the case 150 can be maintained.

Once the drawer 170 is completely accommodated in the case 150, an inner pressure of the case 150 may be lowered to a preset value lower than the atmospheric pressure, by the depressurizing device 183. The open region of the case 150, having a relatively low strength, can be prevented from being transformed due to the transformation preventing members 290 and 300.

When the drawer 170 is to be withdrawn from the case 150, the adjusting member 230 is pulled toward the front side. If the adjusting member 230 is pulled, the adjusting member 230 may rotate about the rotation shaft 234, and the operation bar 240 may move to a releasing position by the pressurizing portion 235.

The operation bar 240 may pressurize the opening/closing member 251 to open the communication portion 250, and may pressurize the hook 211 to release an engaged state between the hook 211 and the locking portion 193.

If the adjusting member 230 is continuously pulled toward the front side, the drawer 170 may be withdrawn to the front side.

The sealed state maintaining device is not limited to the illustrated one, but may be implemented in various manners. With reference to FIGS. 18 to 26, a vegetable chamber having a retaining means will be explained as a modification example of the sealed state maintaining device.

Figure 18:
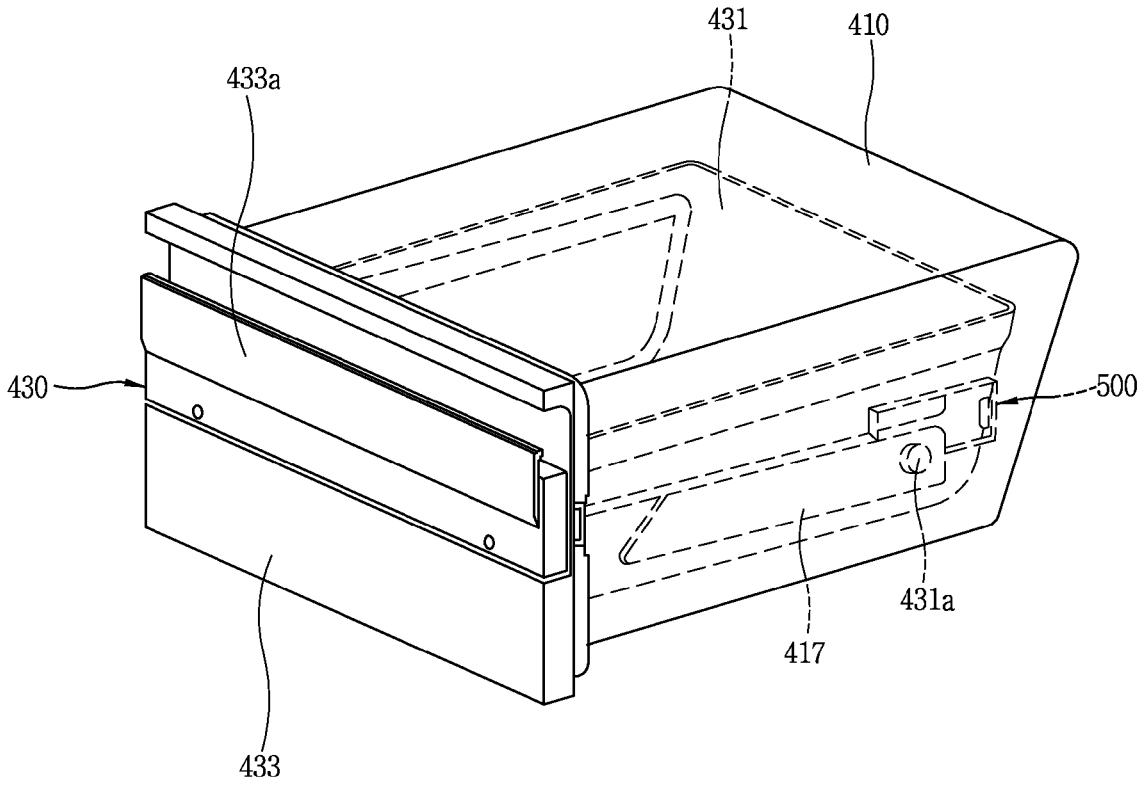
FIG. 18 is a perspective view illustrating a vegetable chamber having a retaining means according to another embodiment of the present invention.
Figure 19:
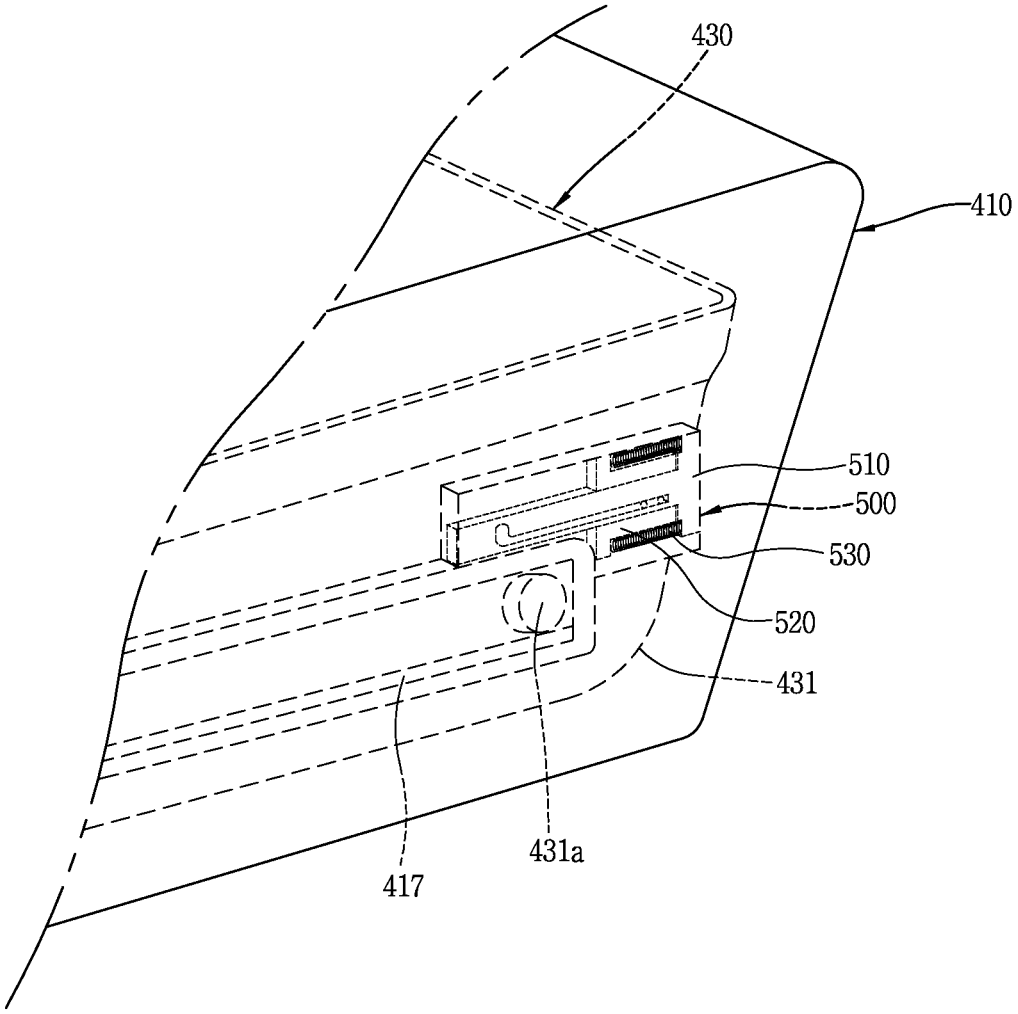
FIG. 19 is a perspective view illustrating inside of the retaining means.

FIG. 18 is a perspective view illustrating a vegetable chamber having a retaining means according to another embodiment of the present invention, and FIG. 19 is a perspective view illustrating inside of a retaining means mounted to a vegetable chamber.

As shown in FIGS. 18 and 19, a vegetable chamber having a retaining means is preferably installed at the rear end of a guide rail 417 provided at the vegetable chamber.

The guide rail 417 protrudes from two inner walls of the case 410, and guides sliding of a drawer 430. The drawer 430 comprises a roller 431*a* which performs a reciprocating sliding motion on the guide rail 417.

When a drawer door 433 is to be closed in the vegetable chamber, a user pushes the drawer door 433 a little. Once the drawer door 433 passes through a prescribed point, the drawer door 433 is closed. If the user pushes the drawer door 433 up to a prescribed point, the drawer 430 is moved toward the rear side of the case 410 by a retaining means 500. As a result, the drawer door 433 comes in contact with the front opening of the case 410 to thus be closed.

On the contrary, when the drawer door 433 is to be open, the drawer 430 is withdrawn as an engaged state of the retaining means 500 is released by a mere force to pull the drawer door 433 without an additional operation.

Under such configuration, an air gap is not generated between the drawer door 433 and the front opening of the case 410, by the retaining means 500 installed at the end of the drawer 430 and at the end of the guide rail 417 of the case 410. Accordingly, inside of the case 410 can be completely sealed.

Referring to FIGS. 3 and 18, the present invention provides a vegetable chamber 400 of a refrigerator, the vegetable chamber 400 comprising: a case 410 accommodated in a prescribed position of the refrigerator, and having an opening on a front surface thereof; a drawer 430 having therein an accommodation portion 431 for storing fruits or vegetables, and inserted into the front opening of the case 410 in a withdrawable manner; a vegetable chamber door 433 formed at a front side of the drawer, and configured to open and close the front opening of the case; and a retaining means 500 mounted at two inner sides of the vegetable chamber, and configured to contact the vegetable chamber door 433 to the front opening of the case 410.

The case 410 comprises a guide rail 417 formed on an inner wall of the case 410, and configured to guide the drawer 430 to be introduced into or withdrawn from the case 410. And the drawer 430 comprises a roller 431*a* installed on an outer wall of the accommodation portion 431, and performing a reciprocating motion back and forth on the guide rail 417.

The guide rail 417 and the roller 431*a* are configured to allow the drawer 430 to be introduced into the case 410 without torsion.

Hereinafter, a configuration and an operation of the retaining means 500 according to the present invention will be explained in more detail with reference to FIGS. 20 to 26.

Figure 20:
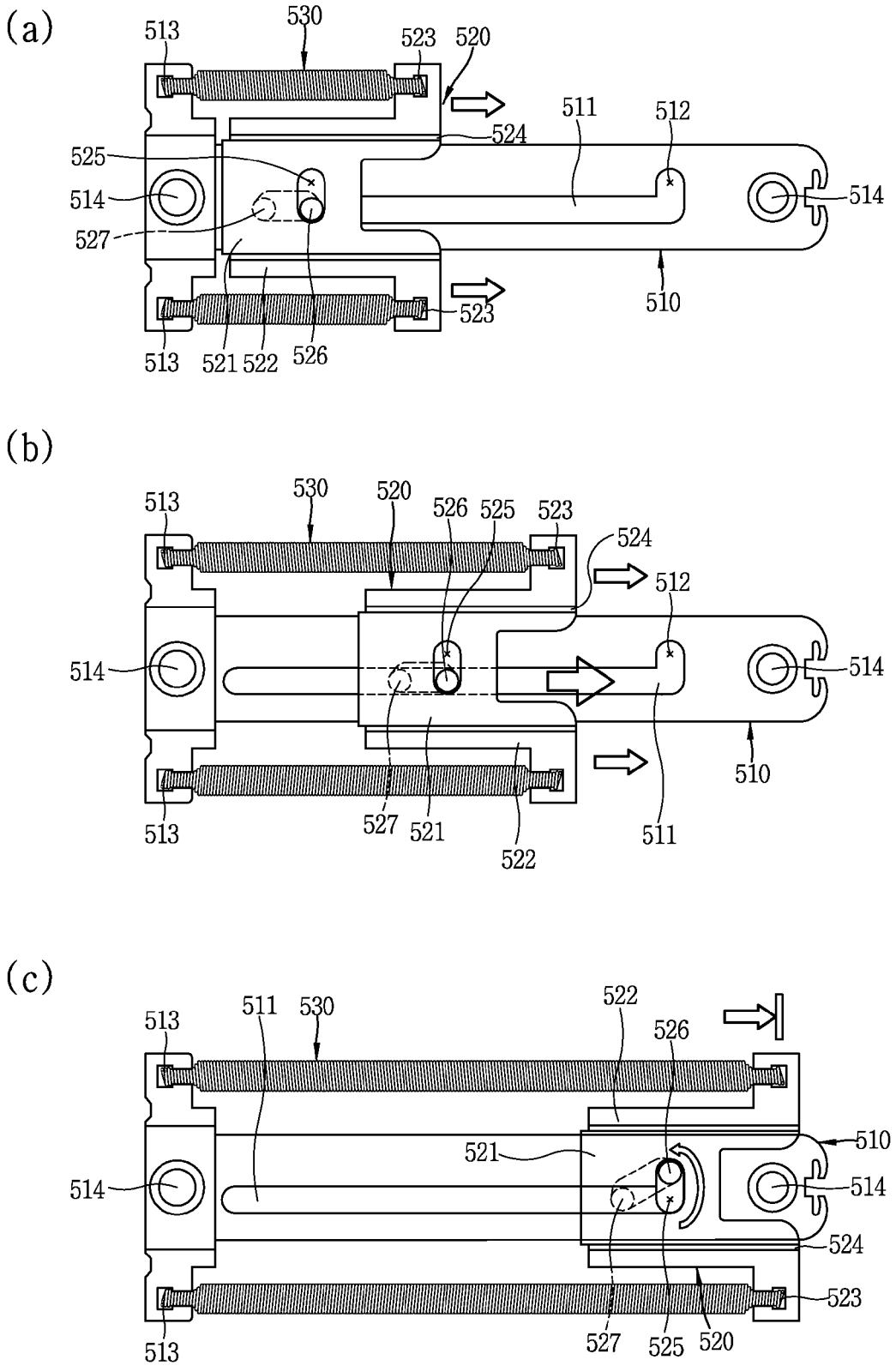
FIG. 20 is a view illustrating an operational relation between a guiding member and a sliding member of the retaining means.
Figure 21:
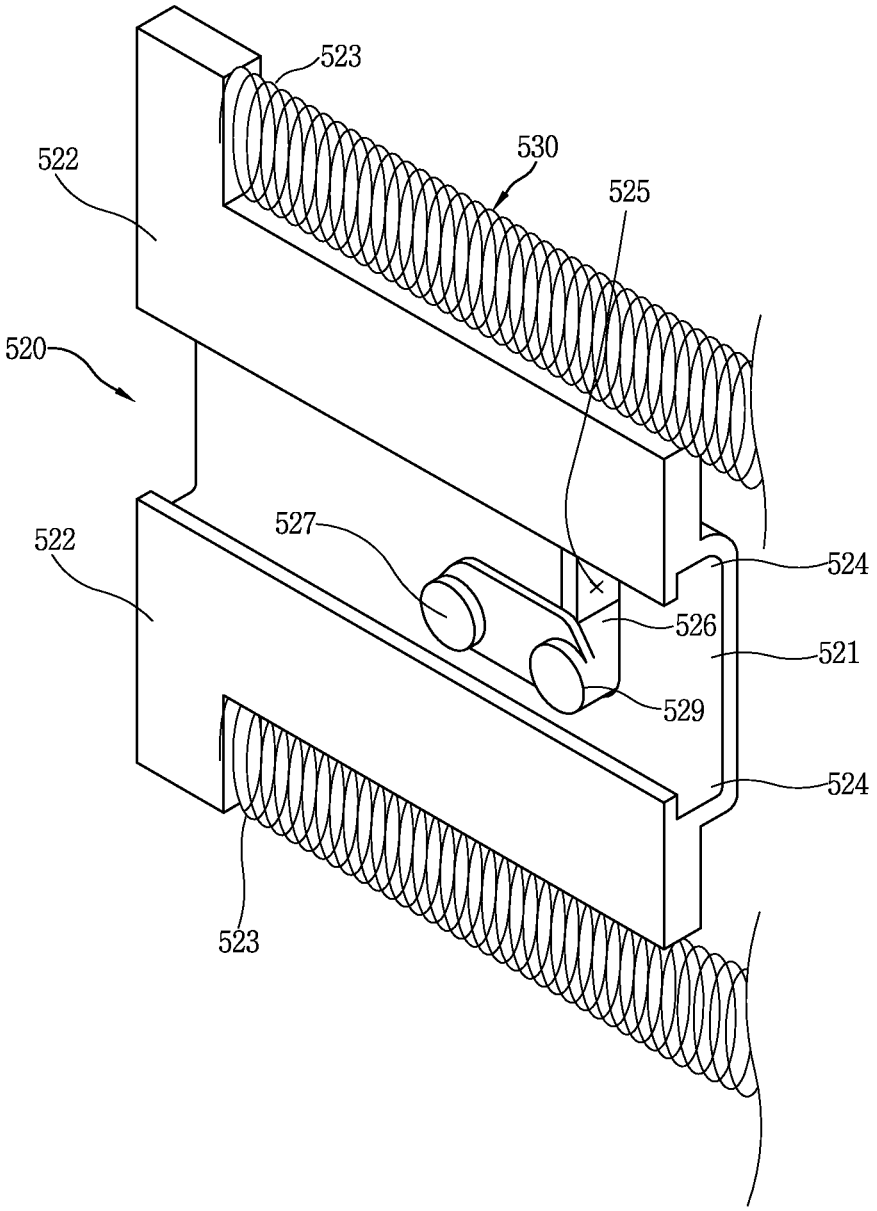
FIG. 21 is a perspective view illustrating the sliding member of the retaining means.
Figure 22:
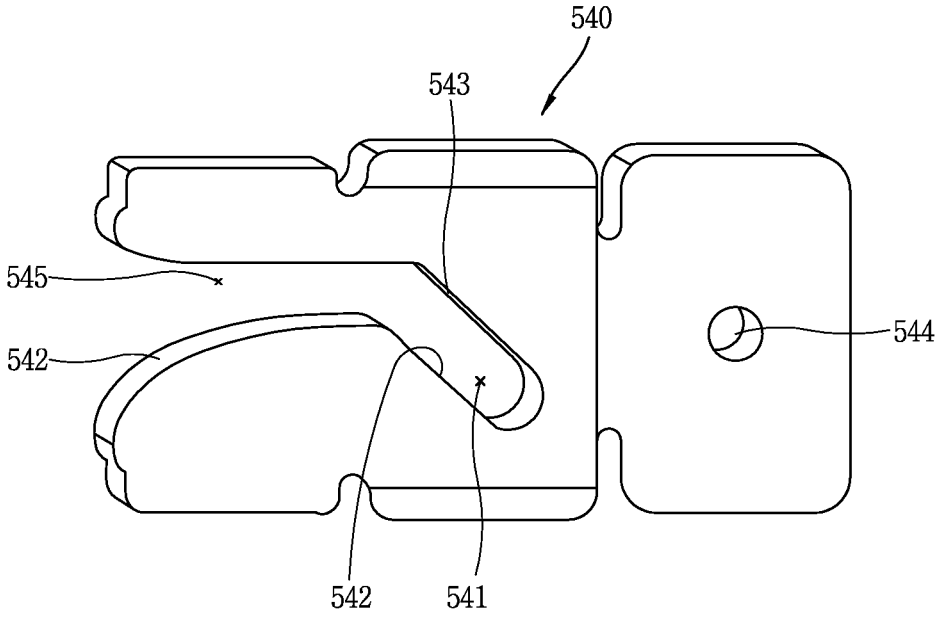
FIG. 22 is a perspective view illustrating a locking member of the retaining means.
Figure 23:
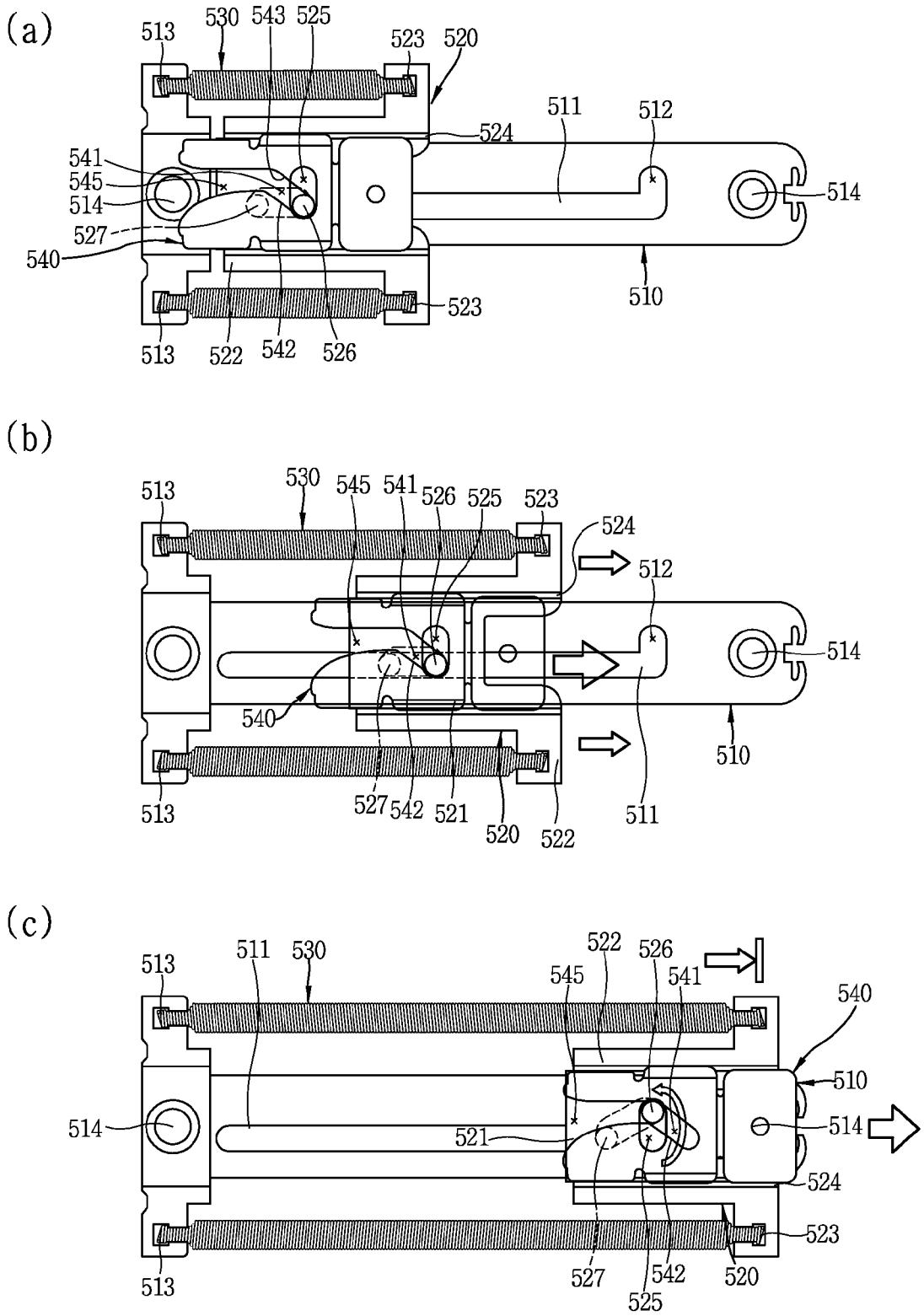
FIG. 23 is a view illustrating an operation of the retaining means.
Figure 24:
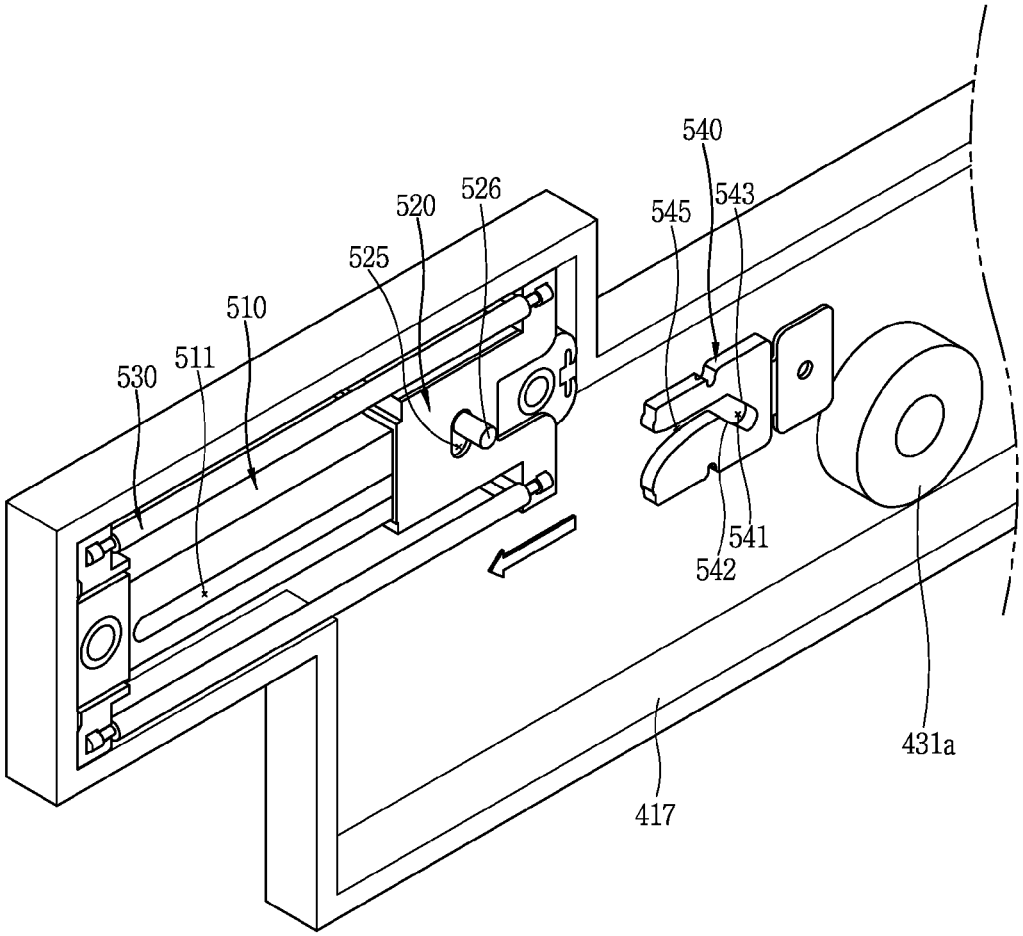
FIGS. 24 to 26 are perspective views illustrating an operation of the retaining means when a drawer of a vegetable chamber is accommodated in a case.
Figure 25:
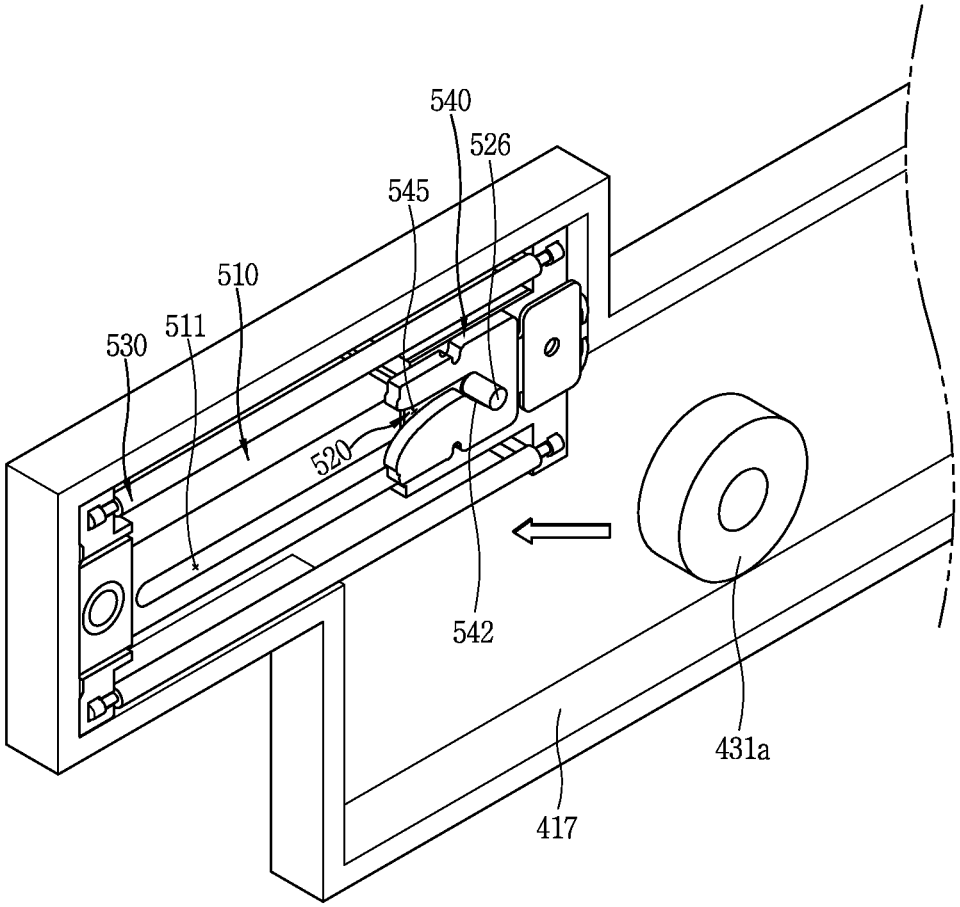
Figure 26:
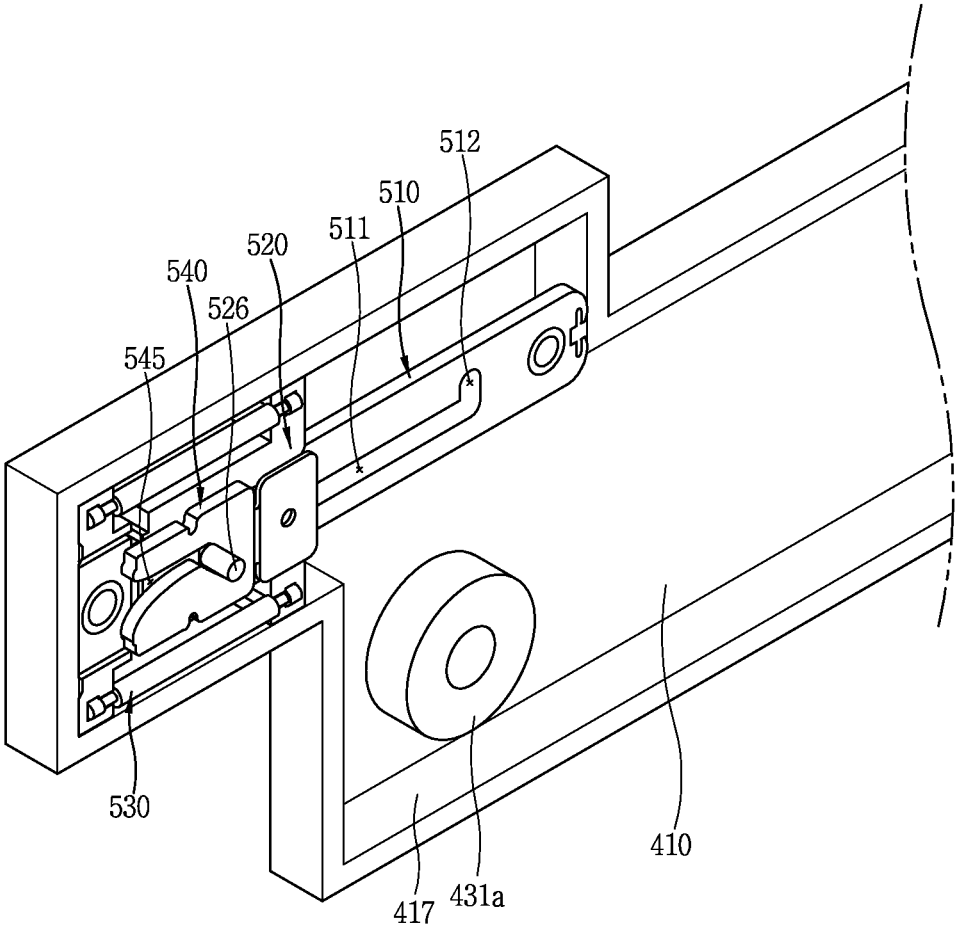

FIG. 20 is a view illustrating an operational relation between a guiding member and a sliding member of the retaining means, FIG. 21 is a perspective view illustrating the sliding member of the retaining means, FIG. 22 is a perspective view illustrating a locking member of the retaining means, FIG. 23 is a view illustrating an operational of the retaining means, and FIGS. 24 to 26 are perspective views illustrating an operation of the retaining means when the drawer of the vegetable chamber is accommodated into the case.

As shown in FIG. 23, the retaining means 500 comprises a guiding member 510 extending from the end of the guide rail 417 of the case 410, fixed to plates disposed at two sides of the case 410, and configured to guide movement of the drawer 430; a sliding member 520 coupled to the guiding member 510 so as to be slidable on the guiding member 510, and configured to contact the drawer door 433 to the front opening of the case 410 by backward pulling the drawer 430; an elastic member 530 having one end fixed to the guiding member 510, having another end fixed to the sliding member 520, and having an elastic restoration force; and a locking member 540 fixed to an inner wall of the drawer 430, performing a reciprocating motion on the guide rail 417 back and forth, selectively locked to the sliding member 520, having a locked state when the drawer 430 is withdrawn from the case 410, and having a released state when the drawer 430 is introduced into the case 410.

Preferably, the guiding member 510 is formed of a plastic member having a high strength and extending back and forth. Since the guiding member 510 is fixed to the case 410, a case fixing portion 514 such as a coupling hole is formed at the guiding member 510 so that an additional coupling bolt, etc. can be coupled thereto.

The guiding member 510 comprises a guiding cut-out slit 511 extending back and forth, and a locking slit 512 bent from a rear end of the guiding cut-out slit.

As shown in FIG. 20, the guiding cut-out slit 511 and the locking slit 512 allow a second protrusion 527 and a third protrusion 529 of the sliding member 520 to be explained later, to reciprocate back and forth. And the guiding cut-out slit 511 and the locking slit 512 make the third protrusion 529 locked by the locking slit 512.

Referring to FIGS. 20 and 21, the sliding member 520 comprises a sliding body 521 which reciprocates back and forth on the guiding member 510; a sliding rib 522 extending from the sliding body 521 in upper and lower directions; and a guide rail 524 to which the guiding member 510 is coupled between the sliding body 521 and the sliding rib 522. Under such configuration, the sliding member 520 can perform a reciprocating sliding motion back and forth on the guiding member 510 by the guide rail 524.

As shown in FIG. 21, the sliding member 520 has a structure that its central part is concaved so that the guiding member 510 can be inserted thereinto. As the edge of the guiding member 510 is slidably coupled to the guide rail 524, the sliding member 520 can perform a reciprocating sliding motion back and forth on the guiding member 510 (refer to FIG. 20).

As shown in FIGS. 20 and 21, the sliding member 520 comprises a through hole 525 penetratingly-formed at the sliding body 521 in a vertical direction; a first protrusion 526 protruding toward an upper side of the through hole 525, and selectively locked by the locking member 540; a third protrusion 529 protruding toward a lower side of the through hole 525 to thus be inserted into the guiding cut-out slit 511, performing a reciprocating sliding motion back and forth, and selectively locked by the locking slit 512. The first protrusion 526 and the third protrusion 529 extend up and down in a state where the through hole 525 is interposed therebetween.

The second protrusion 527, serving as a hinge shaft of the first protrusion 526 and the third protrusion 529, may be formed. The second protrusion is introduced into the guiding cut-out slit 511 from the sliding body 521, and performing a reciprocating sliding motion back and forth.

The second protrusion 527 may be implemented as a hinge shaft fixed to a lower surface of the sliding body 521 of the sliding member 520. Even if the second protrusion 527 is not fixed to the sliding body 521, it is in an inserted state into the guiding cut-out slit 511. Therefore, the second protrusion 527 can serve as a hinge shaft for rotating the first protrusion and the third protrusion.

The guiding member 510 and the sliding member 520 are connected to each other by the elastic member 530. And the sliding member 520 is pulled toward the rear side by an elastic restoration force of the elastic member 530.

As shown in FIG. 20, the elastic member 530 is preferably implemented as an elastic spring having a prescribed elastic coefficient.

The guiding member 510 comprises an elastic member fixing portion 513 to which one end of the elastic member 530 is fixed. And the sliding member 520 comprises an elastic member fixing portion 523 to which another end of the elastic member 530 is fixed.

Hereinafter, an operation that the sliding member 520 performs a reciprocating sliding motion back and forth on the guiding member 510 will be explained with reference to FIGS. 20 and 21.

Referring to FIG. 20(*a*), the sliding member 520 is pulled toward the rear side (left side in FIG. 20) of the guiding member 510 thus to contact thereto, by an elastic restoration force of the elastic member 530. The second protrusion 527 and the third protrusion 529 (refer to FIG. 21) of the sliding member 520 are in an inserted state into the guiding cut-out slit 511.

Referring to FIG. 20(*b*), if the sliding member 520 is forcibly pulled toward the front side (right side in FIG. 20) in a state where the first protrusion 526 has been locked by the locking member 540 fixed to the drawer 430, the second protrusion 527 and the third protrusion 529 of the sliding member 520 are slid toward the front side along the guiding cut-out slit 511.

Referring to FIG. 20(*c*), if the sliding member 520 moves up to the end of the guiding cut-out slit 511 in a state where the first protrusion 526 has been locked by the locking member, the locking member 540 pushes the first protrusion 526 of the sliding member 520 toward the locking slit 512 disposed thereabove, the locking slit 512 for inserting the third protrusion 529 thereinto.

The second protrusion 527 may be implemented as a hinge shaft fixed to a lower surface of the sliding body 521 of the sliding member 520. Even if the second protrusion 527 is not fixed to the sliding body 521, it is in an inserted state into the guiding cut-out slit 511. Therefore, the second protrusion 527 can serve as a hinge shaft for rotating the first protrusion and the third protrusion.

While the first protrusion 526 moves upward by the locking member 540, the third protrusion 529 formed at a rear side of the first protrusion 526 also moves toward the locking slit 512. In this case, the third protrusion 529 is in a fixed state to the locking slit 512, and the first protrusion 526 is in an inserted state into the through hole 525. Accordingly, the sliding member 520 maintains the locked state while maintaining the elastic restoration force of the elastic member 530 (elastic spring).

More specifically, in case of withdrawing the drawer 430 from the case 410, if the drawer 430 is pulled with a force larger than an elastic restoration force of the spring, the sliding member 520 is fixed to the locking slit 512 in a locked manner.

On the contrary, in case of inserting the drawer 430 into the case 410, the first protrusion 526 is downward moved by the locking member 540 fixed to the drawer 430, and the locked state of the third protrusion 527 to the locking slit 512 is released. While the sliding member 520 slides toward the rear side (left side in FIG. 20), the first protrusion 526 is locked by the locking member 540. As a result, the drawer 430 is also pulled together with the sliding member 520.

In case of inserting the drawer 430 into the case 410, a user can make the drawer door 433 contact the case 410 without an additional force, through the operation of the guiding member 510 and the sliding member 520.

Referring to FIG. 22, the locking member 540 comprises a horizontal cut-out slit 434 having an open rear side and to which the first protrusion 526 is inserted; and an inclined cut-out slit 541 forward bent from the horizontal cut-out hole 545, and configured to lock the first protrusion 526.

Upper and lower surfaces of the inclined cut-out slit 541 comprise a first protrusion locking portion 542 configured to forward move the sliding member 520 by locking the first protrusion 526, in case of withdrawing and inserting the drawer 430 from/into the case 410; and a first protrusion locked state releasing portion 543 configured to release a locked state of the third protrusion 529 to the locking slit 512 of the guiding member, by downward pressurizing the first protrusion 526, in case of closing the drawer 430. Under such configuration, in case of inserting the drawer 430 into the case 410, the locking member 540 is locked by the sliding member 520 so that the drawer 430 can be closed.

As shown in FIG. 23, the inclined cut-out slit 541 is preferably bent in an opposite direction to a direction that the locking slit 512 of the guiding member 510 is formed. Referring to FIG. 23, the locking slit 512 upward extends from the guiding cut-out slit 511, and the inclined cut-out slit 541 downward extends from the horizontal cut-out slit 545.

Referring to FIGS. 22 and 23, an operational relation among the guiding member 510, the sliding member 520 and the locking member 540 of the retaining means 500 will be explained. FIG. 23 illustrates a reciprocal operation by the locking member 540 in the same state as that of FIG. 20. Accordingly, an operational relation between the guiding member 510 and the sliding member 520 will be omitted, and an operational relation by the locking member 540 will be explained.

As aforementioned, the locking member 540 is fixed to two outer side walls of the drawer 430 of the vegetable chamber 400. Under such configuration, as shown in FIG. 23(*a*), the first protrusion 526 is in an inserted state into the inclined cut-out slit 541 of the locking member 540, in a state where the drawer 430 is closed.

Referring to FIG. 23(*b*), when the drawer 430 is forcibly pulled for withdrawal, the first protrusion 526 is continuously in a locked state to the first protrusion locking portion 542 of the inclined cut-out slit 541, because the locking member 540 is in a restricted state up and down. At the same time, the sliding member 520 is pulled out together with the locking member 540.

Referring to FIG. 23(*c*), if the sliding member 520 moves up to the front end (right side in drawing) of the guiding member 510, the third protrusion 529 reaches the locking slit 512 of the guiding member 510. The first protrusion locking portion 542 of the inclined cut-out slit 541 provides a force to upward move the first protrusion 526. As a result, the first protrusion 526 and the third protrusion 529 upward move, and the third protrusion 529 is fixed to the locking slit 512 in a locked manner.

While the locking member 540 continuously moves to the front side (right side in FIG. 23), the first protrusion 526 is separated from the discharged from the inclined cut-out slit 541 through the horizontal cut-out slit 545. In this state, the sliding member 520 is fixed to the end of the guiding member 510 with an elastic restoration force.

On the contrary, in case of introducing the drawer 430 into the case 410, if the locking member 540 is in a state of FIG. 23(*c*), the first protrusion 526 is introduced into the horizontal cut-out slit 545 of the locking member, and is pulled to the rear side (left side in FIG. 23).

If the first protrusion locked state releasing portion 543, an upper surface of the inclined cut-out slit 541 is downward pressurized in a contacted state to the first protrusion 526, the third protrusion 529 integrally extending with the first protrusion 526 also downward rotates to thus be separated from the locking slit 512.

The sliding member 520 is forcibly slid to the rear side (left side in FIG. 23) by an elastic restoration force, by the third protrusion 529 separated from the locking slit 512. In this case, the first protrusion 526 maintains the locked state to the first protrusion locking portion 542, because it is in an inserted state into the inclined cut-out slit 541.

The sliding member 520 is pulled toward the rear side in a state where the first protrusion 526 has been locked to the first protrusion locking portion 542. Accordingly, the drawer 430 is also forcibly pulled toward the rear side to implement an automatic closing function. Since the drawer door 433 receives an elastic restoration force continuously, it contacts the open region of the case 410 to thus seal the vegetable chamber.

Referring to FIGS. 24 to 26, the retaining means 500 of the present invention comprises a locking member 540 fixed to the drawer 430, and a guiding member 510 fixed to the case 410. The retaining means 500 further comprises a sliding member 520 which performs a reciprocating sliding motion back and forth on the guiding member 510.

The retaining means 500 is installed at the rear end of the guide rail 417 of the case 410. When the drawer 430 is closed, the locking member 540 fixed to the drawer 430 is backward slid along the guide rail 417. And the locking member 540 is coupled to the locking slit 512 of the guiding member 510, and is introduced toward the rear side of the case by the elastic member 530 (spring). As the drawer door 433 contacts the front opening of the case 410, an inner space of the vegetable chamber is sealed.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a refrigerator body having a cooling chamber;

a case comprising a case body having therein an accommodation space and an open region, and a transformation preventing member formed of a material having a higher strength than that of the case body, the transformation preventing member provided at the open region of the case body to prevent transformation of the case;

a drawer accommodated in the case in a withdrawable manner; and a depressurizing device to depressurize an inside of the drawer and the case to a pressure lower than an outside pressure of the case, when the drawer is accommodated in the case, wherein the case body comprises a plurality of protrusions and ribs protruding from an outer surface of the case body in a manner of being perpendicular to each other, wherein the case body comprises a flange portion, which extends to outside, and is provided at the open region of the case body, wherein the transformation preventing member is disposed on a surface of the flange portion, and wherein a mounting portion is provided at a rear surface of the flange portion and concaved from the rear surface of the flange portion in a thickness direction so that the transformation preventing member is inserted therein.

2. The refrigerator of claim 1, further comprising:

a protrusion portion protruding from one of contact surfaces between the flange portion and the transformation preventing member; and an accommodation portion formed at another of the contact surfaces, and to accommodate the protrusion portion.

3. The refrigerator of claim 1, wherein the transformation preventing member comprises:

a horizontal section horizontally disposed above the case body; and vertical sections bent downward from two ends of the horizontal section.

4. The refrigerator of claim 1, wherein the transformation preventing member comprises a first part transformation preventing portion and a second part transformation preventing portion that are disposed on the surface of the flange portion to contact each other in a facing manner.

5. The refrigerator of claim 4, wherein the first part transformation preventing portion comprises a horizontal section horizontally disposed above the case body, and vertical sections bent downward from two ends of the horizontal section, and the second part transformation preventing portion comprises a horizontal section horizontally disposed below the case body, and vertical sections bent upward from two ends of the horizontal section.

6. The refrigerator of claim 5, further comprising a coupling protrusion that protrudes from one of contact surfaces between the first part transformation preventing portion and the second part transformation preventing portion, toward the other, and wherein a coupling protrusion accommodation portion is formed at another of the contact surfaces to accommodate the coupling protrusion.

7. The refrigerator of claim 1, wherein the transformation preventing member is inserted into a wall of the flange portion.

8. The refrigerator of claim 1, further comprising:

a sealing member provided at a contact region between the drawer and the open region of the case body;

a sealed state maintaining device comprising a locking portion provided at the case, and a coupling member movable to engage with the locking portion in a sealing position in which the sealing member is compressed between the open region of the case body and the drawer accommodated in the case, thereby sealing the inside of the drawer and the case. and the coupling member movable to disengage with the locking portion in a releasing position to be released from the sealed position; and an adjusting member provided at the drawer to move the coupling member between the sealing position and the releasing position.

9. The refrigerator of claim 8, wherein the coupling member comprises:

a hook which rotates about a rotation shaft; and a hook spring to provide an elastic force to the hook such that the hook rotates to engage the locking portion in the sealing position.

10. The refrigerator of claim 9, further comprising:

an operation bar provided between the adjusting member and the hook, to transmit to the hook, a driving force to disengage the hook from the locking portion when the adjusting member moves.

11. The refrigerator of claim 10, wherein the drawer is provided with a communication portion that is configured to communicate inside and outside of the drawer with each other.

12. The refrigerator of claim 11, further comprising an opening and closing member that is configured to open and close the communication portion.

13. The refrigerator of claim 8, wherein the sealing member is formed of rubber to be pressed by a pressing force of the drawer, and wherein the sealing member has an annular shape to be contactable with the flange portion.

14. The refrigerator of claim 1, further comprising a retainer mounted in the case to allow a drawer door to contact the open region of the case by a backward pulling of the drawer into the case by the retainer when the drawer is introduced into the case.

15. The refrigerator of claim 14, wherein the case comprises a guide rail disposed at an inner wall of the case to guide the drawer to be introduced into or withdrawn from the case; and wherein the retainer comprises:

a guiding member extending from an end of the guide rail of the case and fixed to the inner wall of the case, to guide movement of the drawer;

a sliding member coupled to the guiding member so as to be slidable on the guiding member;

an elastic member having one end fixed to the guiding member, having another end fixed to the sliding member, and having an elastic restoration force to provide the backward pulling of the drawer by the sliding member; and a locking member fixed to an outer wall of the drawer, to reciprocate with the drawer on the guide rail, having a locked state to lock the sliding member when the drawer is withdrawn from the case, and having a released state in which the sliding member is released from the locked state when the drawer is introduced into the case.

16. The refrigerator of claim 15, wherein the sliding member comprises:

a sliding body which reciprocates on the guiding member;

a sliding rib extending from the sliding body; and a guide rail to which the guiding member is coupled between the sliding body and the sliding rib, wherein the sliding member performs a reciprocating sliding motion on the guiding member through the guide rail.

17. The refrigerator of claim 16, wherein the guiding member comprises:

a guiding cut-out slit extending back and forth; and a locking slit bent from a rear end of the guiding cut-out slit.

18. The refrigerator of claim 17, wherein the sliding member comprises:

a through hole penetratingly-formed at the sliding body in a vertical direction;

a first protrusion protruding toward an upper side of the through hole, and selectively locked by the locking member;

a third protrusion protruding toward a lower side of the through hole and inserted into the guiding cut-out slit, to perform a reciprocating sliding motion back and forth, and to be selectively locked by the locking slit, wherein the first protrusion and the third protrusion extend up and down in a state where the through hole is interposed therebetween.

19. The refrigerator of claim 18, wherein the sliding member comprises a second protrusion introduced into the guiding cut-out slit from the sliding body, to perform a reciprocating sliding motion, and to serve as a hinge shaft of the first protrusion and the third protrusion.

20. The refrigerator of claim 1, wherein the depressurizing device is implemented as a vacuum pump.

21. The refrigerator of claim 20, further comprising a connection pipe that is configured to communicate the case and the vacuum pump with each other.

22. A refrigerator, comprising:

a refrigerator body having a cooling chamber, a case comprising a case body having therein an accommodation space and an open region, and a transformation preventing member formed of a material having a higher strength than that of the case body, the transformation preventing member provided at the open region of the case body to prevent transformation of the case;

a drawer accommodated in the case in a withdrawable manner; and a depressurizing device to depressurize an inside of the drawer and the case to a pressure lower than an outside pressure of the case, when the drawer is accommodated in the case, wherein the drawer is provided with a communication portion that is configured to communicate inside and outside of the drawer with each other, further comprising an opening and closing member that is configured to open and close the communication portion, wherein the opening and closing member comprises:

an elastic portion that is configured to open and close the communication portion;

a supporting portion that is configured to support the elastic portion; and an elastic member that is configured to apply an elastic force to the supporting portion such that the supporting portion is moved close to the communication portion.

23. The refrigerator of claim 22, wherein the opening and closing member further comprises an operation rod that protrudes from the supporting portion and is inserted through the communication portion so as to come in contact with the operation bar.

24. A refrigerator, comprising:

a refrigerator body having a cooling chamber, a case comprising a case body having therein an accommodation space and an open region, and a transformation preventing member formed of a material having a higher strength than that of the case body, the transformation preventing member provided at the open region of the case body to prevent transformation of the case;

a drawer accommodated in the case in a withdrawable manner; and a depressurizing device to depressurize an inside of the drawer and the case to a pressure lower than an outside pressure of the case, when the drawer is accommodated in the case, a sealing member provided at a contact region between the drawer and the open region of the case body;

a sealed state maintaining device comprising a locking portion provided at the case, and a coupling member movable to engage with the locking portion in a sealing position in which the sealing member is compressed between the open region of the case body and the drawer accommodated in the case, thereby sealing the inside of the drawer and the case, and the coupling member movable to disengage with the locking portion in a releasing position to be released from the sealed position; and an adjusting member provided at the drawer to move the coupling member between the sealing position and the releasing position, wherein the adjusting member comprises:

a plate portion that has a shape of a long plate;

a rotation shaft accommodation portion that is provided at a rear surface of the plate portion; and a pressuring portion that extends from the rotation shaft accommodation portion in a different direction from the plate portion and is configured to pressurize the operation bar.

* * * * *